US011649706B2

(12) United States Patent
Van Krevel

(10) Patent No.: US 11,649,706 B2
(45) Date of Patent: May 16, 2023

(54) PUMP JACK SYSTEM

(71) Applicant: POC Hydraulic Technologies, LLC, Columbus, OH (US)

(72) Inventor: John Van Krevel, Dublin, OH (US)

(73) Assignee: POC HYDRAULIC TECHNOLOGIES, LLC, Dublin, OH (US)

( * ) Notice: Subject to any disclaimer, the term of this patent is extended or adjusted under 35 U.S.C. 154(b) by 357 days.

(21) Appl. No.: 16/933,381

(22) Filed: Jul. 20, 2020

(65) Prior Publication Data

US 2021/0032966 A1 Feb. 4, 2021

Related U.S. Application Data

(60) Provisional application No. 63/034,580, filed on Jun. 4, 2020, provisional application No. 62/887,266, filed on Aug. 15, 2019, provisional application No. 62/880,222, filed on Jul. 30, 2019.

(51) Int. Cl.
*E21B 43/12* (2006.01)
*F04B 47/14* (2006.01)
(Continued)

(52) U.S. Cl.
CPC ..... *E21B 43/127* (2013.01); *E21B 47/009* (2020.05); *F04B 23/02* (2013.01);
(Continued)

(58) Field of Classification Search
CPC ..... E21B 43/127; E21B 47/009; F04B 23/02; F04B 47/026; F04B 47/145; F04B 49/00; F04B 53/08; F04B 49/06; F04B 47/022
See application file for complete search history.

(56) References Cited

U.S. PATENT DOCUMENTS 3,277,730 A 10/1966 Chastain
4,125,163 A * 11/1978 Fitzpatrick ..... G05D 9/12 166/250.03

(Continued)

OTHER PUBLICATIONS

International Search Report.
Written Opinion.

*Primary Examiner* — Jonathan Malikasim
(74) *Attorney, Agent, or Firm* — Ralph E. Jocke; Walker & Jocke

(57) ABSTRACT

An exemplary pump jack system (10) is operable to cause well liquid to be pumped to the surface by a subsurface well pump (29). The exemplary system includes a driver (42) that is in rotatable connection with a pump/motor (48). The pump/motor is a rotary type variable output positive displacement pump/motor that delivers working liquid at a selectively variable flow rate in closed liquid connection to a motor/pump (38). The exemplary motor/pump includes a rotatable output coupler (40) that is in operative connection with a gearbox (34) which causes the pump jack to undergo reciprocating motion. The motor/pump is a rotary type positive displacement motor/pump that is in closed liquid connection with the pump/motor liquid inlet of the pump motor. The pump/motor is operable to deliver working liquid flow therefrom to drive the motor/pump at a selectively variable speed while the driver operates at a generally constant rotational speed. Return force which acts on the motor/pump during at least a portion of the pump jack cycle is operative to cause the motor/pump to urge working liquid toward the pump/motor which assists the driver in pump/motor operation.

34 Claims, 17 Drawing Sheets

(51) Int. Cl.

| | |
|---|---|
| ***F04B 47/02*** | (2006.01) |
| ***E21B 47/009*** | (2012.01) |
| ***F04B 49/00*** | (2006.01) |
| ***F04B 53/08*** | (2006.01) |
| ***F04B 23/02*** | (2006.01) |

(52) U.S. Cl.
CPC ..... *F04B 47/026* (2013.01); *F04B 47/145* (2013.01); *F04B 49/00* (2013.01); *F04B 53/08* (2013.01)

(56) References Cited

U.S. PATENT DOCUMENTS

| | | | | |
|---|---|---|---|---|
| 4,238,966 | A | 12/1980 | Carlson et al. | |
| 4,249,376 | A | 2/1981 | Weckerly | |
| 4,353,445 | A | 10/1982 | Moss | |
| 4,406,122 | A * | 9/1983 | McDuffie | F04B 47/022 417/399 |
| 5,996,688 | A | 12/1999 | Schultz et al. | |
| 7,490,674 | B2 | 2/2009 | Brecheisen | |
| 7,530,799 | B2 * | 5/2009 | Smith | F04B 47/04 417/904 |
| 7,533,730 | B1 * | 5/2009 | Corsentino | F04B 47/04 166/250.15 |
| 8,087,904 | B2 * | 1/2012 | Best | E21B 43/127 417/904 |
| 8,523,533 | B1 * | 9/2013 | Best | F04B 1/32 417/904 |
| 9,377,010 | B1 * | 6/2016 | Madgwick | F04B 47/04 |
| 9,429,001 | B2 * | 8/2016 | Best | F04B 47/04 |
| 9,810,213 | B2 * | 11/2017 | Pons | F04B 51/00 |
| 9,938,804 | B2 | 4/2018 | Haarstad | |
| 2016/0265321 | A1 * | 9/2016 | Elmer | G05B 19/042 |

* cited by examiner

PUMP JACK SYSTEM

TECHNICAL FIELD

Exemplary arrangements relate to pump jack systems.

BACKGROUND

Pump jacks are used to pump oil and other liquids from wells that extend below the earth's surface. A pump jack commonly includes a walking beam that is rotatably supported above ground on a frame. The walking beam moves relative to the frame about a pivot. One end of the walking beam on one side of the pivot is operatively connected to a polished rod that extends into a wellbore. The polished rod extends through a seal which is alternatively referred to as a stuffing box, near the top of the wellbore. The polished rod is connected to a stringer including a plurality of sucker rods that are connected in series and extend down in the wellbore. The string of sucker rods is connected to a subsurface rod well pump located at the bottom of the well.

The end of the walking beam on the opposite side of the pivot from the end connected to the polished rod, is connected to a crank arm. The crank arm may sometimes be in connection with at least one counterweight that helps to balance the weight of the sucker rods that are connected to the opposite side of the walking beam. The crank arm is connected to a gearbox which is alternately referred to herein as a gear reducer or a transmission, which rotates the arm and counterweights about an axis of rotation.

The gearbox is in operative connection with a prime mover which is alternatively referred to herein as a driver. In some arrangements the driver may be an electric motor. In other arrangements driver may be an internal combustion engine or other suitable device for providing rotational energy.

In operation of the pump jack the driver supplies rotational energy to the gearbox. The gearbox rotates the crank arm including the counterweights. The crank arm causes the walking beam to undergo a rocking reciprocating motion about the pivot. The rocking reciprocating motion of the walking beam causes the polished rod and the sucker rods to move in a reciprocating motion up and down. This reciprocating motion of the sucker rods causes an attached piston which is alternatively referred to as a plunger, in the subsurface pump to repeatedly move up and down.

In a common pump arrangement there is a traveling valve that moves with the sucker rod string, and a stationary standing valve at the bottom of the pump. These valves act in a manner similar to check valves so that on the upstroke of the piston the traveling valve is closed and the standing valve is open. This allows the subterranean well liquid to be drawn upward in the well. On the downstroke of the piston the traveling valve opens and the standing valve closes. This displaces the liquid that is in the pump during that downstroke to the upper side of the traveling valve. Repeating this reciprocating action over and over causes the well liquid to be moved upward through the tubing in which sucker rods extend. The well liquid flows out of an opening near the top of the wellbore and is directed through suitable pipes into a storage tank or a pipeline. The rate at which the well liquid is delivered from the well is determined by factors such as the amount well liquid currently available at the downhole pump, the pump speed, the stroke length and the diameter of the plunger. Often natural gas separates from the well liquid and flows upward in the annulus between the tubing and a well casing. The natural gas can be captured at the top of the casing and directed away from the well casing.

Pump jack systems commonly operate unattended in remote locations for prolonged periods of time. Severe service conditions can result in component failures which are time-consuming and costly to repair. Changes in well conditions can also result in varying forces and conditions which result in damage or breakage.

Pump jack systems may benefit from improvements.

SUMMARY

Exemplary arrangements relate to a pump jack system that is driven by a driver such as an internal combustion engine. The driver is in operative connection with a rotary type variable output positive displacement pump/motor. The pump/motor includes a liquid inlet through which the pump/motor receives working liquid such as a hydraulic fluid, and a liquid outlet through which working liquid is delivered from the pump/motor at a selectively variable flow rate.

A positive displacement motor/pump includes a motor/pump liquid inlet and a motor/pump liquid outlet. The motor/pump liquid inlet is in closed liquid connection with the pump/motor liquid outlet. The motor/pump liquid outlet is in closed liquid connection with the pump/motor liquid inlet.

A rotatable output coupler of the motor/pump is in operative connection with a gearbox. The gearbox is connected to the crank arm and counterweights of a pump jack. Rotation of the output coupler of the motor/pump is operative to cause rotation of the crank arm and reciprocating rocking action of the walking beam. The walking beam causes the string of sucker rods to vertically reciprocate which causes the well pump to move the subterranean well liquid to the surface.

In exemplary arrangements the driver drives the pump/motor at a generally constant rotational speed. The speed of the driver corresponds to a suitable point on the power curve of the driver that provides both an adequate power level for the pump/motor and driver operating efficiency. The exemplary pump/motor rotates at a generally constant speed in corresponding relation with the speed of the driver.

The exemplary system includes at least one controller. The controller is in operative connection with the pump/motor. The flow rate of working liquid delivered from the pump/motor liquid outlet is varied through operation of the at least one controller responsive to sensors that detect features which correspond to the current direction of movement and position of the string of sucker rods.

The working liquid that is output from the pump/motor liquid outlet is delivered at an elevated pressure to the motor/pump liquid inlet. The working liquid causes the rotatable output coupler of the motor/pump to rotate in a first rotational direction to drive the gearbox. The speed of the rotatable output coupler and the gearbox is varied during reciprocating motion of the pump jack responsive to the flow rate of working liquid delivered to the motor/pump liquid inlet.

Working liquid that passes through the motor/pump is delivered from the motor/pump liquid outlet. Working liquid from the motor/pump liquid outlet is directed in closed liquid connection to the pump/motor liquid inlet. In exemplary arrangements varying forces such as those caused by the counterweights and the sucker rod string that act on the pump jack as it undergoes its cycle, cause the pump jack to apply a return force through the gearbox that on the output coupler of the motor/pump. The return force urges the output coupler to rotate in the first rotational direction. This causes the motor/pump to operate as a pump responsive to the return force. The return force urges the working liquid to flow from the motor/pump liquid outlet to the pump/motor liquid inlet. The increased level of working fluid pressure at the pump/motor liquid inlet acts to assist the pump/motor in its pumping action and to also assist the driver in rotation of the pump/motor. This reduces the energy that is required from the driver to operate the pump/motor.

Numerous additional features of the described exemplary arrangements operate to provide precise control of pump jack movements, minimize the risk of excessive forces and adverse conditions that may cause damage or breakage, and optimize operation to prolong the life of the system.

DETAILED DESCRIPTION

Figure 1:
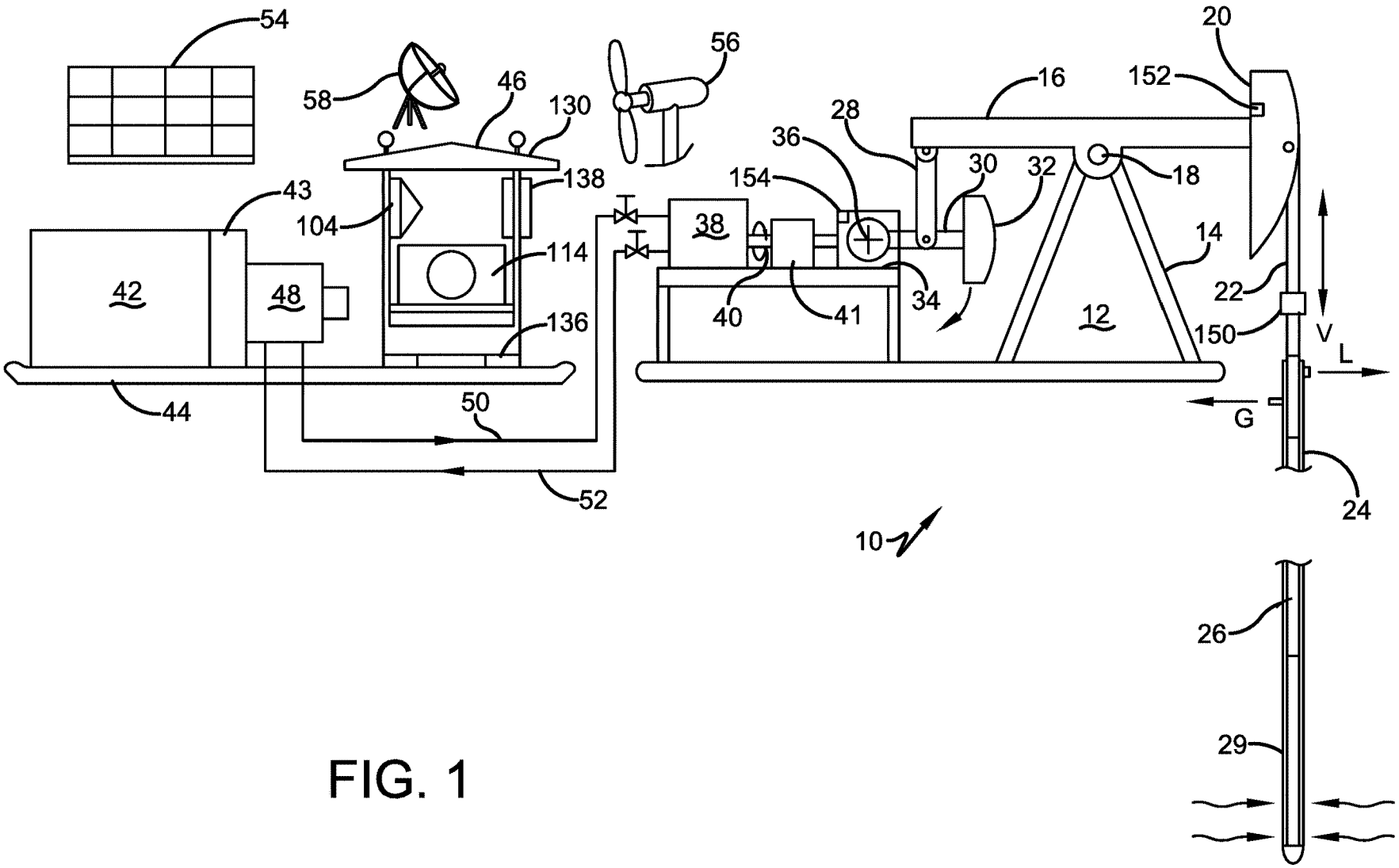
FIG. 1 is a schematic representation of an exemplary pump jack system arrangement.

Referring now to the drawings and particularly to FIG. 1 there is shown therein an exemplary pump jack system 10. The exemplary system includes a pump jack 12. The pump jack 12 includes a frame 14 which is sometimes referred to as a sampson post. A walking beam 16 is movably supported on the frame 14 through a pivot 18. At a first end of the walking beam a connecting member 20 which is sometimes referred to as a horse head, is positioned. The connecting member 20 is in operative connection with a polished rod 22. The polished rod extends into a well casing 24. The polished rod is connected to a sucker rod string 26. The sucker rod string is in operative connection with a moveable piston of a subsurface pump 29.

On the opposite end of the walking beam 16 from the connecting member 20, the walking beam is rotatably connected to a link 28. Link 28 is in rotatable connection with a crank arm 30. The crank arm 30 is connected to at least one counterweight 32. A gearbox 34 is in operative connection with the crank arm 30. The gearbox operates to cause the crank arm to rotate about an axis 36.

The gearbox 34 is in operative rotatable connection with a motor/pump 38. Motor/pump 38 of the exemplary arrangement is a rotary type fixed positive displacement hydraulic motor pump that operates responsive to the flow of liquid working fluid which is alternatively referred to herein as working liquid. The exemplary motor/pump 38 drives the gearbox 34 through a rotatable output coupler 40. The rotatable output coupler operates to rotate in a first rotational direction to cause the crank arm 30 to rotate in the clockwise direction as shown in FIG. 1. In some exemplary arrangements the output coupler 40 may be connected to the gearbox 34 through a speed changing connecting drive 41. In some arrangements the drive 41 may operate to increase the rotational speed that is output from the motor/pump 38 to a suitable higher speed level for input to the gearbox 34. In other arrangements the drive 41 may reduce the rotational speed from the motor/pump 38 to a lower level for input to the gearbox 34. The drive 41 may also include suitable bearings, supports and other structures for purposes of resisting axial and/or radial loads that act on the drive, suitable structures that absorb and attenuate vibrations, as well as connectors which are operative to accommodate slight axial misalignment between drive line components. The speed changing connecting drive may include various types of drive train components such as belts and sheaves, gears, chains, rollers or other suitable members for transmitting rotational movement and changing the rotational speed thereof.

The exemplary system further includes a prime mover which is alternatively referred to herein as a driver 42. In the exemplary arrangement the driver 42 comprises an internal combustion engine or an electric motor. In some exemplary arrangements the driver 42 operates responsive to the combustion of well gas that is obtained from the top of the casing of the well that is in operative connection with the pump jack. Of course it should be understood that this driver is exemplary and in other arrangements other types of drivers may be used. In some exemplary arrangements the driver 42 is in operative connection with a speed changing connecting drive 43. The speed changing connecting drive 43 may include structures like those discussed in connection with the speed changing connecting drive 41. The speed changing connecting drive 43 may be used in arrangements where the output speed from the driver 42 needs to be increased or decreased for purposes of operating system components. In the exemplary arrangement the driver is in operatively supported connection with a skid 44. A control stand 46 which is later described in detail is in operative supported connection with the skid 44.

The driver 42 is in operative rotatable connection through drive 43 with a pump/motor 48. The exemplary pump/motor is a rotary type positive displacement variable output pump/motor. The exemplary pump/motor delivers working liquid at a selectively variable flow rate. The pump/motor is in closed liquid connection through a pump/motor output liquid line 50 with the motor/pump 38. The motor/pump 38 is also in closed liquid connection with the pump/motor 48 through a motor/pump output liquid line 52 which returns working liquid from the motor/pump to the pump/motor.

As later described in detail the flow of working liquid from the positive displacement pump/motor 48 to the positive displacement motor/pump 38 is operative to cause the gearbox 34 to be driven through the rotatable output coupler 40. The gearbox 34 operates to cause the crank arm 30 to rotate which causes movement of the link 28 and rocking reciprocated motion of the walking beam 16. The walking beam in turn causes the polished rod and the sucker rod string 26 to reciprocate up and down along the direction of Arrow V. The repeated cyclical reciprocating motion of the sucker rod string causes the subsurface pump 29 to push well liquid upward in the tube in the wellbore and out of the top thereof as represented by Arrow L. The exemplary well also generates well gas which separates from the well liquid and passes upward in the well casing on the outside of the tube housing the well liquid and sucker rod string. The well gas exits the well as represented by Arrow G. In exemplary arrangements the well gas may be used as the fuel for the driver 42.

In some exemplary arrangements the system 10 may further include solar panels 54. The solar panels 54 provide electricity used by at least one controller of the system. Alternatively or in addition exemplary arrangements may include a wind turbine electric generator 56. A wind turbine electric generator may be used to provide electrical power to the system. Some exemplary arrangements may further include a wireless communication portal including an antenna such as a satellite dish 58. In some exemplary arrangements wireless communications may be used to communicate information regarding the operational status of the system to a remote location. Such communications may also be used in some arrangements to enable the system to be remotely controlled and monitored. Of course these device arrangements are exemplary and in other arrangements other types of devices and components may be utilized.

Figure 2:
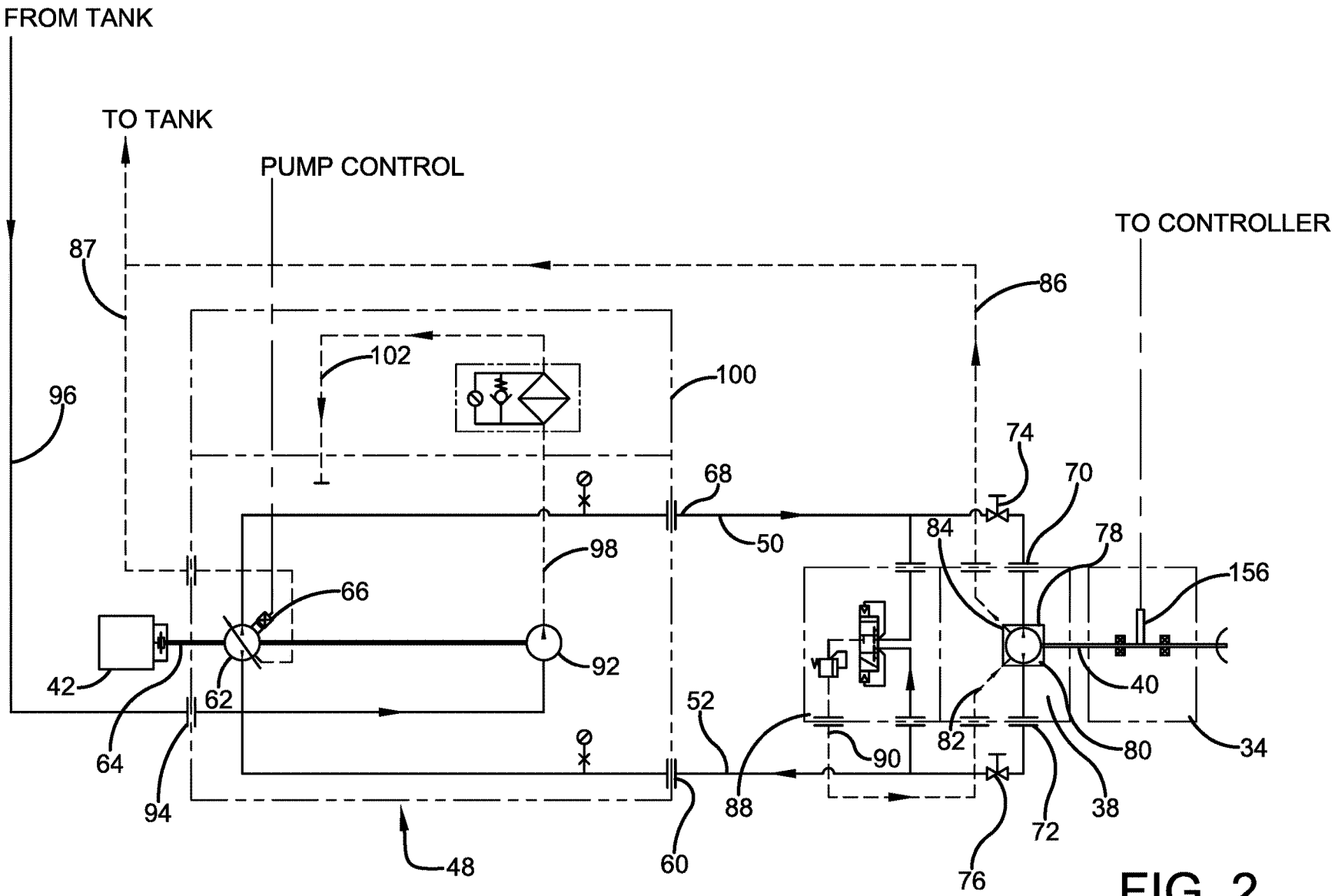
FIG. 2 is a schematic view showing the flow of working liquid in an exemplary arrangement.

As shown in FIG. 2 the pump/motor 48 of the exemplary arrangement is of the variable positive displacement swash plate type. In such devices the working liquid flow rate through the pump/motor is controlled responsive to the controlled angular position of a swash plate. A rotating housing including a plurality of cylinders each with respective axially movable pistons is positioned within the pump/motor case 62. The pistons move axially in operatively engaged relation with the swash plate within the pump/motor. Selectively varying the angle of the swash plate causes the pump/motor to provide working liquid flow that is selectively variable in a continuous range from a zero (0) flow rate (which corresponds to the swash plate being positioned so that there is no piston movement within the cylinders) to a maximum flow rate (which corresponds to the swash plate being positioned at the maximum angular displacement so that each of the pistons undergoes the maximum stroke during each rotation of the rotating housing). As can be appreciated the angular position of the swash plate may also be controlled to enable the pump/motor to provide flow of working liquid in either direction through the pump/motor. Pump/motors which operate using these principles are commercially available from Parker Hannifin Corporation as Denison Gold Cup® piston pumps/motors. Of course other brands of such pump/motors may be used in other exemplary arrangements.

The exemplary pump/motor 48 includes a pump/motor liquid inlet 60. The pump/motor liquid inlet receives working liquid from the motor/pump output liquid line 52. In the exemplary arrangement the pump/motor liquid inlet 60 receives working liquid at in an elevated pressure responsive at least in part to a return force which is applied to the motor/pump 38 by the pump jack as later explained. Pump/motor 48 includes a rotatable input coupler 64 which is rotatably driven by the driver 42 in a driving direction. In the exemplary arrangement the input coupler is operative to rotate the housing in which the plurality of pistons are located in a manner like that previously discussed. In some arrangements the speed changing connecting drive 43 is operatively intermediate of the driver and the pump/motor. A control valve 66 is in operative connection with the swash plate. The control valve 66 is operative to selectively deliver working liquid therethrough. Selective delivery of working liquid through the control valve 66 causes the swash plate to be selectively angularly positioned to cause the pump/motor 48 to pump the working liquid through the pump/motor at a selectively variable flow rate. In the exemplary arrangement the control valve is in operative electrical connection with at least one controller of a type that is later discussed. The pump/motor 48 further includes a pump/motor liquid outlet 68. The pump/motor liquid outlet 68 is in fluid connection with the pump/motor output liquid line 50.

The motor/pump 38 includes a motor/pump liquid inlet 70. The motor/pump liquid inlet 70 receives the delivered working liquid from the pump/motor liquid outlet. The motor/pump 38 also includes a motor/pump liquid outlet 72. The motor/pump liquid outlet delivers the return liquid that is returned to the pump/motor liquid inlet 60. It should be noted that while in the exemplary arrangement shown, the motor/pump 38 is a fixed positive displacement motor/pump, in other arrangements a selectively variable positive displacement motor/pump may be used. A manually closable lockout valve 74 is positioned fluidly immediately adjacent to the motor/pump liquid inlet 70. A further manually closable lockout valve 76 is positioned fluidly immediately adjacent to the motor/pump liquid outlet 72. The purpose of the lockout valves 74, 76 is so that the motor/pump 38 can be fluidly isolated. By manually closing both lockout valves the fluid in the motor/pump acts to hold the motor/pump locked in its current rotational position. Thus the valves serve as a brake which can help to hold the rotatable output coupler 40, components of the drive 41, components of the gearbox 34, and other components connected to the pump jack in fixed position. This can be useful in servicing and repair activities in which components of the pump jack or other items need to be held in a fixed position. Of course this approach is exemplary and other arrangements other approaches may be used.

The exemplary motor/pump 38 includes a motor/pump case 78. The motor/pump case 78 includes a motor/pump lubricating chamber 80. The motor/pump lubricating chamber includes a motor/pump lubricating chamber inlet 82 and a motor/pump lubricating chamber outlet 84. The motor/pump lubricating chamber outlet is in fluid connection with a line 86. Line 86 is fluidly connected to a line 87 that conducts working liquid from the pump/motor case 62. Line 87 is operative to conduct the liquid from the outlet 84 on the motor/pump case to a heat exchanger and working liquid holding tank later described.

A shuttle valve 88 is in liquid connection with pump/motor output liquid line 50 and motor/pump output liquid line 52. The shuttle valve 88 is configured to draw a relatively small amount of the working liquid from the liquid line having the lower working liquid pressure. In the configuration shown in FIG. 2 the shuttle valve 88 is operative to draw working liquid from the motor/pump output liquid line 52. The shuttle valve includes a shuttle valve outlet 90 that is in fluid connection with the motor/pump lubricating chamber inlet 82.

In the exemplary operational condition represented in FIG. 2, the shuttle valve 88 is operative to pass a relatively small amount of the working liquid from the motor/pump liquid outlet 72 and the motor/pump output liquid line 52, to the shuttle valve outlet 90. The working liquid passes from the shuttle valve outlet 90 through the motor/pump lubricating chamber inlet 82. The working liquid then passes through the motor/pump lubricating chamber 80, and from the motor/pump lubricating chamber outlet 84 to the line 86. This flow of the working liquid provides lubrication as well as cleaning and cooling action for components within the motor/pump case 78.

The flow of the working liquid through the shuttle valve and the motor/pump case is accomplished without the working liquid interfering with the efficiency of the motor/pump components that operate to cause rotation of the output coupler 40 in response to the working liquid flow that passes from the motor/pump liquid inlet 72 the motor/pump liquid outlet 72. This flow through the shuttle valve is further accomplished without the working liquid that is allowed to pass through the shuttle valve 88 disrupting the closed liquid connection between the motor pump liquid outlet 72 and the pump/motor liquid inlet 60. For purposes hereof closed liquid connection shall be interpreted to mean that the outlet pressure available from the motor/pump liquid outlet to the pump/motor liquid inlet (or from the pump/motor liquid outlet in the case of the connection between the pump/motor liquid outlet and the motor/pump liquid inlet) is not diminished by intermediate components to a degree that reduces the available pressure so as to result in cavitation of the pump/motor (or the motor/pump) to which the working liquid is delivered. Further, the closed liquid connection provides delivery of the working liquid to each respective liquid inlet of the pump/motor and the motor/pump at an elevated pressure that provides a liquid driving force to the respective motor/pump and the pump/motor.

In some exemplary arrangements the motor/pump 38 may comprise a commercially available motor/pump such as a Parker Hannifin Corporation Series F12™ motor/pump. Of course in other exemplary arrangements other types of motor/pumps may be used.

The exemplary pump/motor 48 further includes an auxiliary pump 92. The auxiliary pump 92 is a fixed positive displacement pump that is in operative driven connection with the driver 42. In the exemplary arrangement the auxiliary pump 92 is operative to receive working liquid through an auxiliary pump liquid inlet 94 which is in connection with a line 96. Line 96 is operative to deliver working liquid from a holding tank. Working liquid is discharged from the auxiliary pump 92 to a line 98 which is fluidly connected to a filter 100. In the exemplary arrangement the filter 100 is a replaceable filter that is accessible externally of the pump/motor 48. The filtered working liquid is returned through a line 102 to the pump/motor. The filtered liquid from the line 102 is operative to replace working liquid that is drawn off from the motor/pump output liquid line 52 through the shuttle valve 88. As a result the amount of working liquid that is passing between the pump/motor and the motor/pump is maintained constant.

Figure 3:
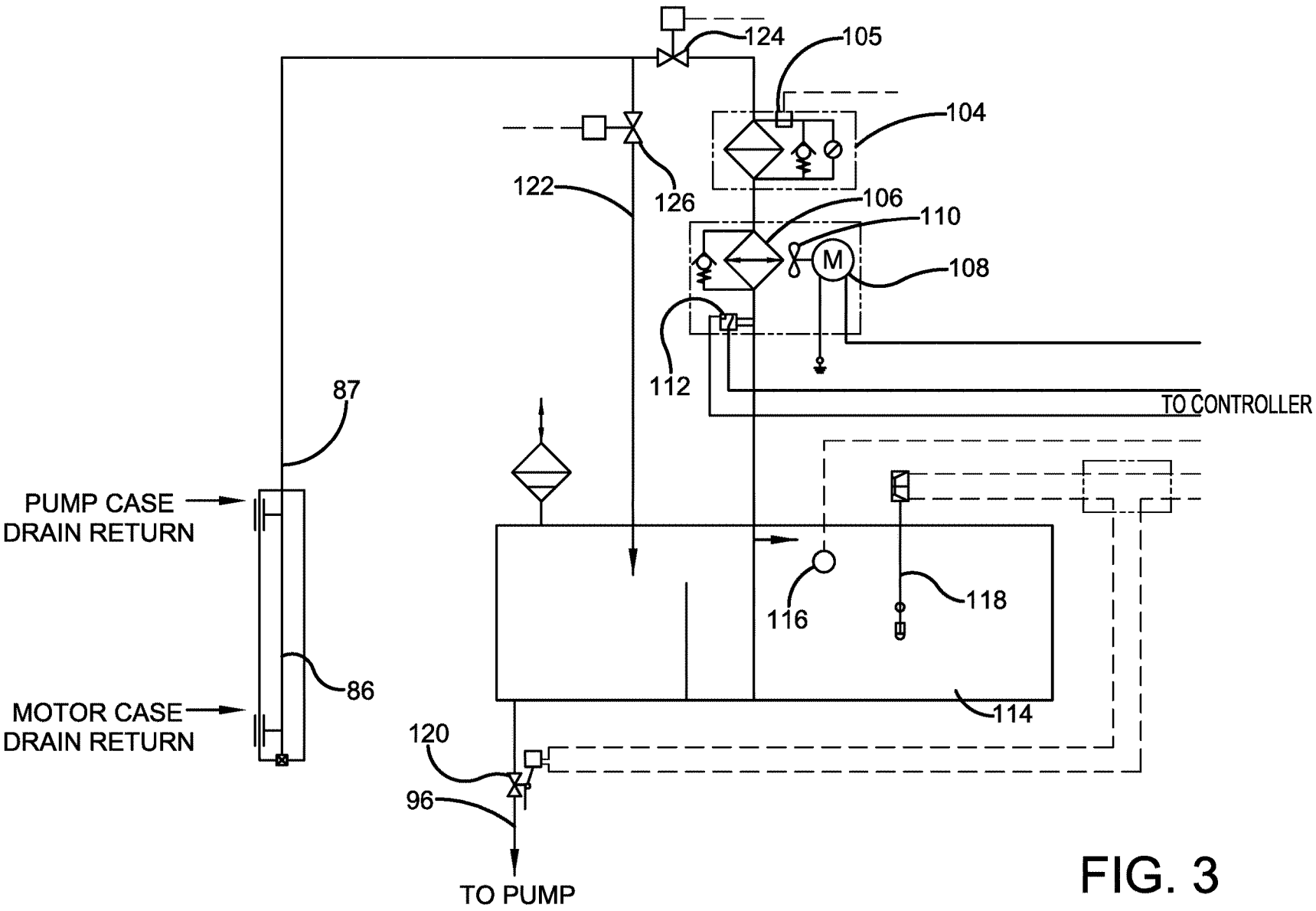
FIG. 3 is a schematic view showing a portion of an exemplary system that operates to cool and house the working liquid.
Figure 5:
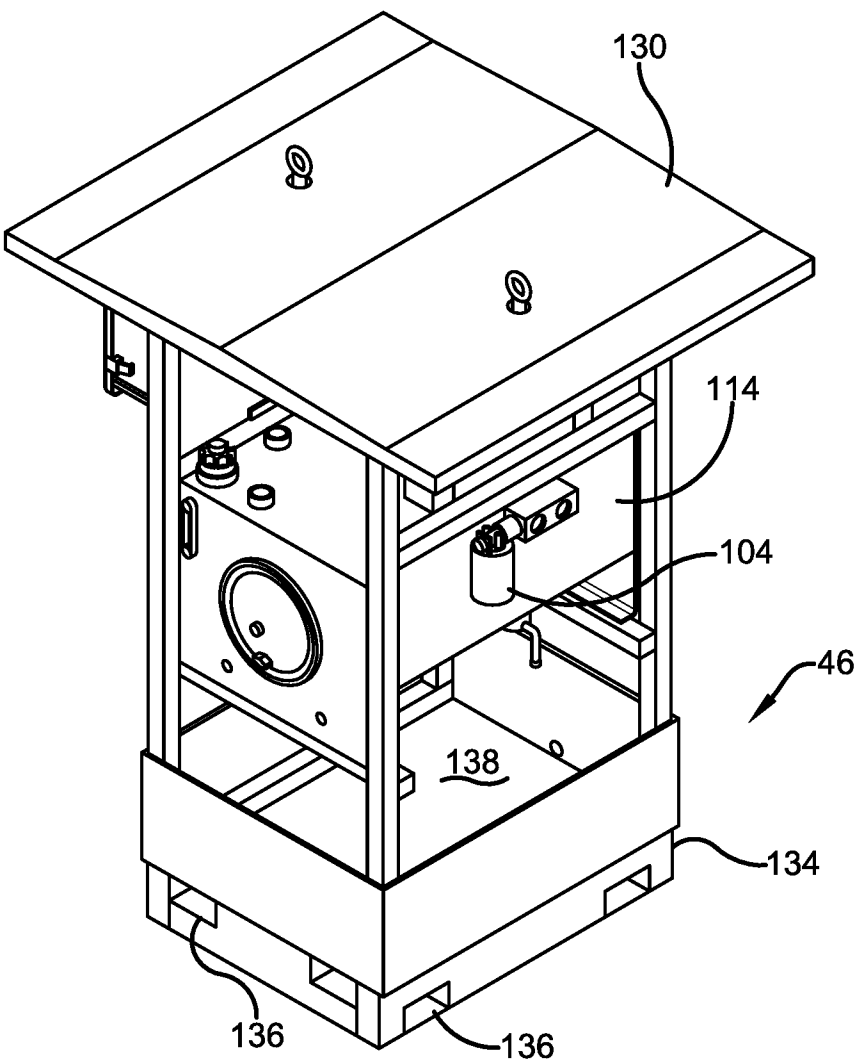
FIG. 5 is a back top left perspective view of the control stand.
Figure 4:
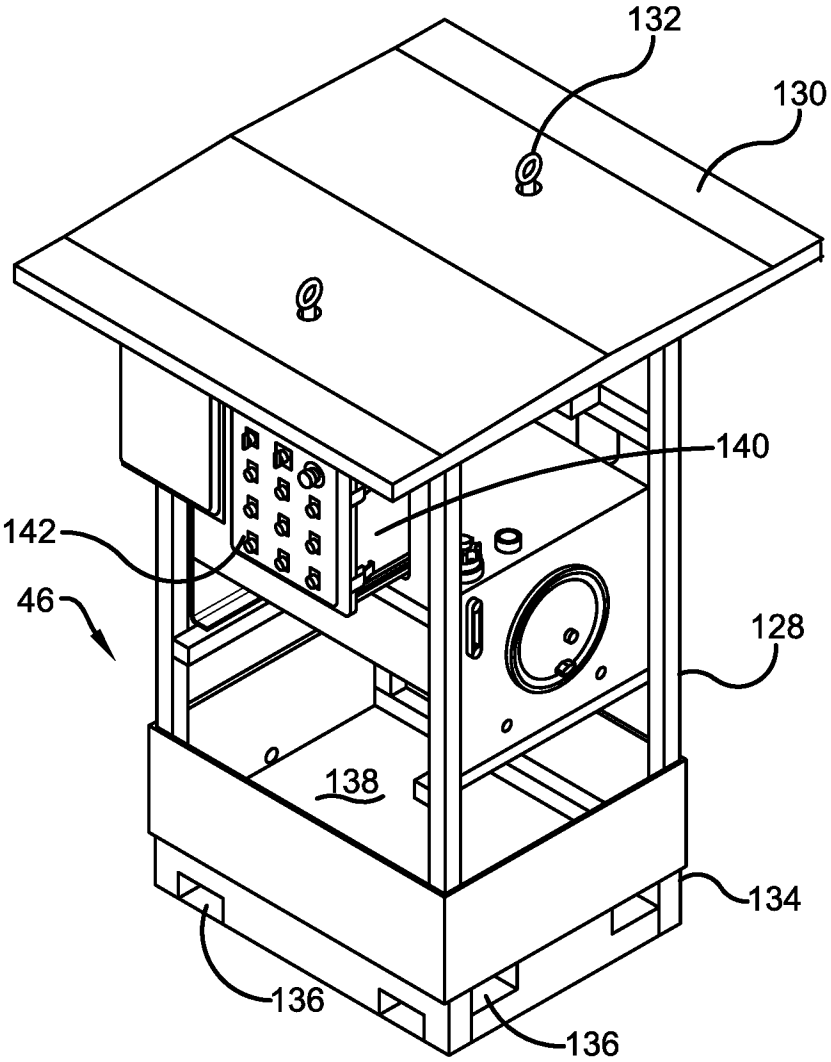
FIG. 4 is a front top right perspective view of an exemplary control stand used in an exemplary arrangement.

As shown in FIG. 3, the exemplary return line 87 from the motor/pump case 78 and the pump/motor case 62 is fluidly connected to a filter 104. The exemplary filter 104 is in operative fluid connection with at least one filter sensor 105. The at least one filter sensor 105 is operative to sense at least one property such as flow or pressure, that is indicative of unduly restricted flow through the filter. Such a filter sensor 105 may be indicative that the filter is in a restricted flow condition which indicates the filter is clogged or is close to becoming clogged, such that there may be inadequate flow of the working liquid therethrough. The at least one filter sensor 105 is in operative connection with at least one controller of the type later discussed.

Filter 104 is operative to remove contaminants from the return working liquid and deliver the cleansed working liquid to a liquid/air heat exchanger 106. The liquid/air heat exchanger 106 includes an electric motor 108 that is operative to selectively drive at least one fan 110. The motor that drives the fan 110 is in electrical connection with at least one controller of the type that is later discussed. The exemplary heat exchanger further includes at least one working liquid temperature sensor 112. The at least one liquid temperature sensor 112 is operative to detect temperature of the working liquid on an outlet side of the heat exchanger 106. The temperature sensor 112 is operative to indicate to the at least one controller the temperature of the working liquid leaving the heat exchanger. The at least one controller is operative to cause the at least one fan to operate to maintain the temperature of the working liquid leaving the heat exchanger below at least one programmed threshold.

A working liquid tank 114 is operative to receive the working liquid from the heat exchanger 106. Tank 114 includes therein a further at least one working liquid temperature sensor 116 that is in operative connection with the at least one controller. At least one working liquid level sensor 118 is operative to detect a level of working liquid housed within the tank 114. The level sensor 118 is in operative connection with the at least one controller.

The line 96 is connected to the tank 114. As previously discussed, the line 96 is operative to deliver working liquid to the auxiliary pump 92. An electrically controlled valve 120 is operative to control the flow from the tank through line 96. In the exemplary arrangement the valve 120 is in operative connection with the at least one controller. In exemplary arrangements the valve 120 is usable to close off working liquid flow to the auxiliary pump 92. Closing off such flow is operative to cause the auxiliary pump to cease providing fluid pressure to the control valve 66 that controls the angular position of the swash plate. As a result closing valve 120 causes a loss of pressure that results in the swash plate moving to a 0 flow condition. This feature can be used to avoid causing damage to the pump/motor or other components in the system when a problem is detected by the at least one controller.

In the exemplary arrangement, a bypass line 122 fluidly extends between line 87 and the tank 114. A pair of electrically actuated bypass valves 124, 126 are positioned in each of lines 87 and 122 respectively. Bypass valves 124, 126 are each in operative electrical connection with the at least one controller. As can be appreciated, with the bypass valve 126 in the closed condition the working fluid passes through line 87 through the filter 104, the heat exchanger 106 and to the tank. With the bypass valve 124 in the closed condition and the bypass valve 126 in the open condition, working liquid from line 87 is passed through bypass line 122 directly to the tank. In this condition the filter 104 and heat exchanger 106 are bypassed. This bypass condition may be utilized when the working fluid is cold and below at least one temperature threshold. In such conditions the at least one controller may operate the system in a warm up mode later discussed so as to heat the working fluid to a temperature above a suitable threshold for operation of the motor/pump and other components. Of course it should be understood that this arrangement for storing, cooling and delivering the working liquid is exemplary and in other arrangements other types of components and approaches may be used.

In the exemplary system the tank 114, the heat exchanger 106 and the filter 104 are in operatively supported connection with the control stand 46. As shown in FIGS. 4-7, the exemplary control stand 46 includes a rectangular frame 128 which supports a roof 130 at an upper end. A pair of lifting eyes 132 are in operative connection with the roof 130 to facilitate lifting the control stand and placing it in position at a work site. As shown in FIG. 1 the exemplary control stand may be in operatively supported connection with the skid 44. However in other arrangements the control stand 46 may be supported on other structures and surfaces.

The exemplary stand 46 includes a base 134. The frame 128 is in operative connection with the base 134. The base includes on each side at least one lifting fork opening 136. The lifting fork openings are configured to receive at least one lifting fork therein. The lifting fork may be of the type on a lift truck, tractor lift or other suitable device for moving and placing the control stand 46 in a desired position.

In the exemplary arrangement a catch pan 138 is positioned below the tank 114. The catch pan 138 is closed on all sides except the top. The catch pan is operative to catch working liquid oil that may spill from the tank during filling, draining or operation of the unit. The catch pan 138 may avoid the occurrence of a spill into the environment under such circumstances.

The exemplary control stand 46 is further in operatively supported connection with at least one control panel 140. The at least one control panel 140 houses at least a portion of at least one controller. The exemplary at least one control panel further includes a plurality of manual input devices and visual indicators 142. The input devices and indicators enable the user to provide inputs to the control circuitry housed within the control panel and also to receive outputs from the indicators.

Figure 7:
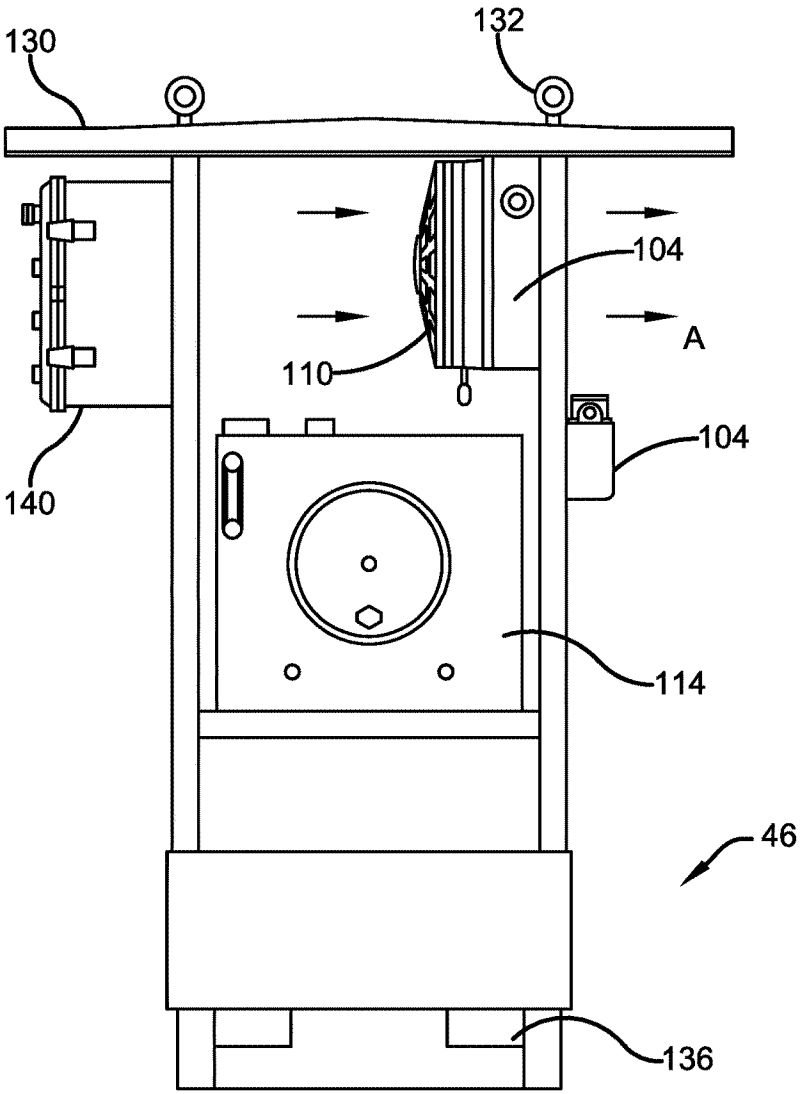
FIG. 7 is a right side view of the control stand.
Figure 6:
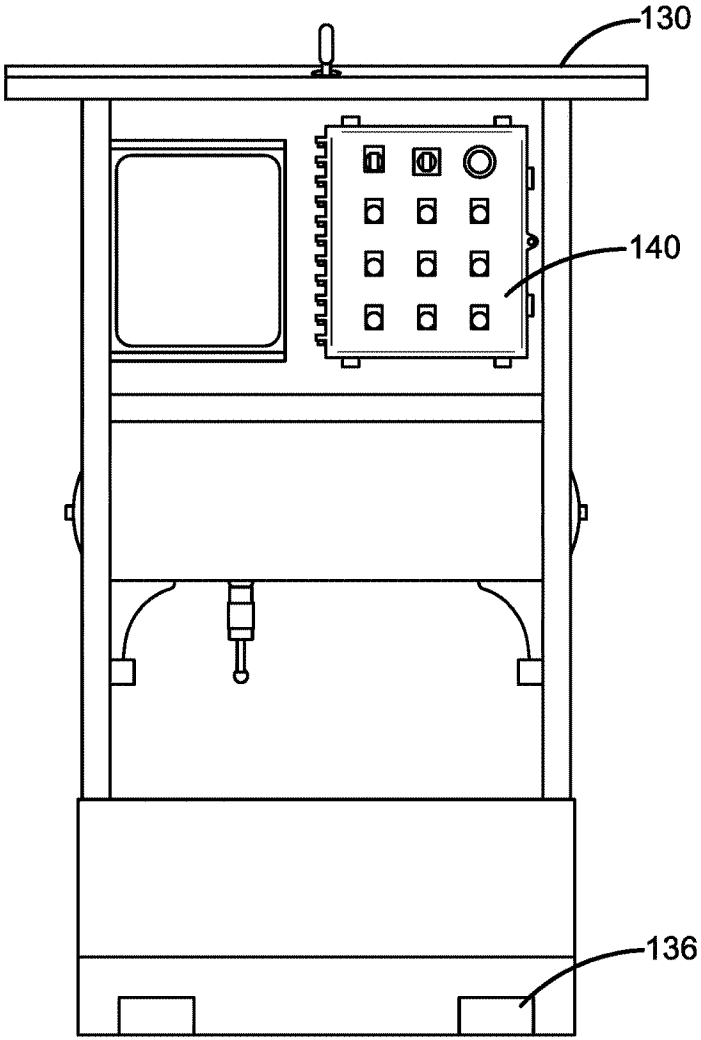
FIG. 6 is a front view of the control stand.
Figure 8:
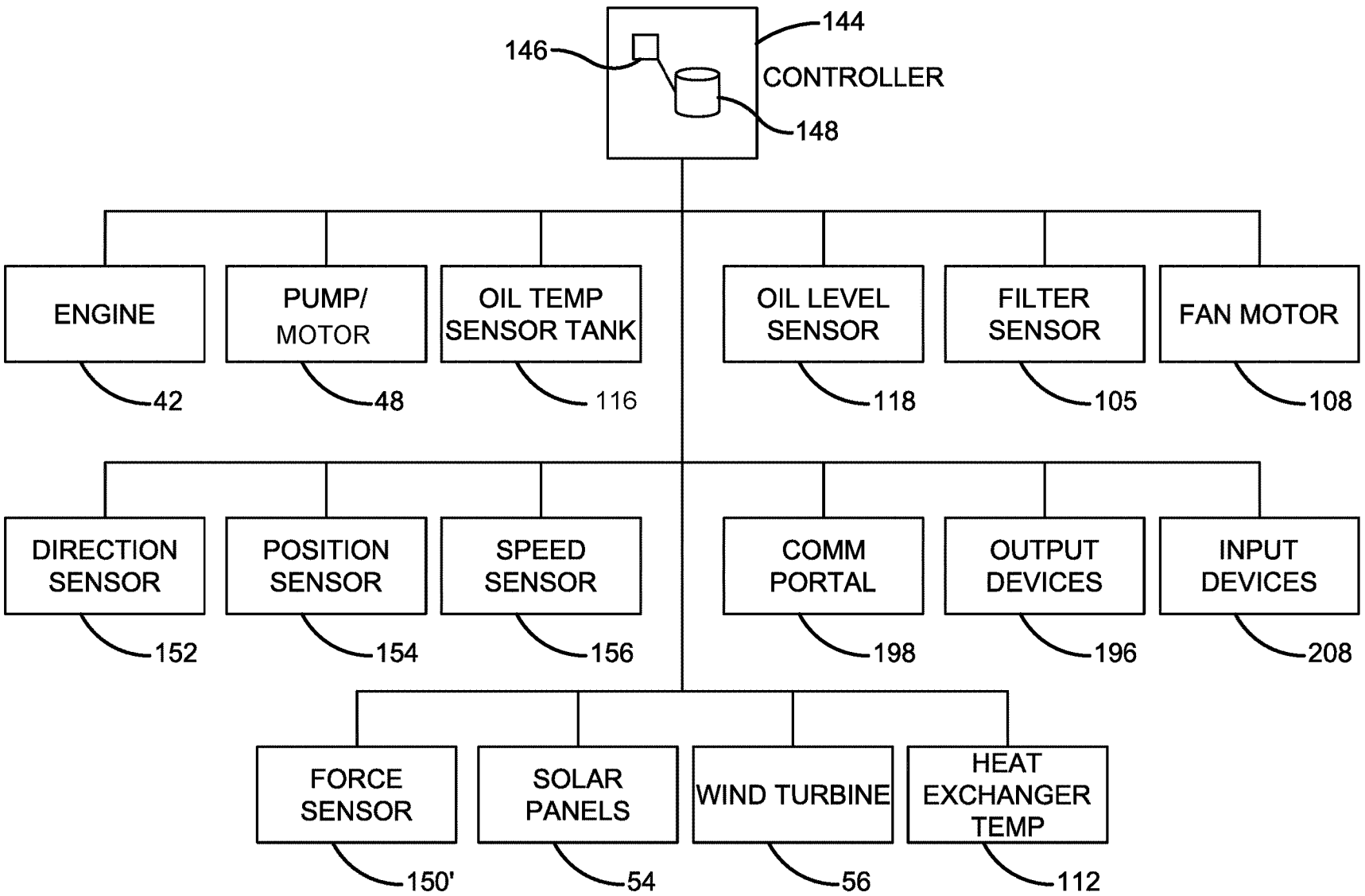
FIG. 8 is a schematic view of a controller and system components included in an exemplary arrangement.

As best shown in FIG. 7 the exemplary control stand 46 is arranged such that the at least one fan 110 associated with the heat exchanger 104 is operative to cause airflow in the direction of Arrows A. In the exemplary arrangement the fan 110 is operative to move air for cooling purposes. The exemplary fan operates to push air through the liquid/air heat exchanger to cool the working liquid, while at the same time drawing air over the at least one control panel 142 to provide cooling thereof. Further as shown, in the exemplary arrangement the roof 130 extends above the at least one control panel, the tank, the filter and the heat exchanger so as to reduce the direct exposure thereof to the elements and reduce the risk of damage thereto. Of course it should be understood that this configuration of the control stand 46 holding these system components is exemplary and in other arrangements other approaches for positioning and supporting system components may be utilized.

The exemplary system includes at least one controller 144. In exemplary arrangements the at least one controller includes circuitry that is operative to communicate electrical signals and control the operation of devices that are in operative connection with the at least one controller. In exemplary arrangements the at least one controller 144 includes suitable switches, relays and other circuitry which are operable to receive signals and provide desired outputs. Further in exemplary arrangements the at least one controller includes at least one circuit including at least one processor schematically indicated 146 and at least one data store schematically indicated 148. Exemplary arrangements may include a processor suitable for carrying out circuit executable instructions that are stored in the one or more associated data stores 148. The exemplary processor includes or is in connection with nonvolatile storage media including instructions that include a basic input/output system (BIOS). For example, processors may correspond to one or more of the combination of a CPU, FPGA, ASIC or other integrated circuit or other type of circuit that is capable of processing data and instructions.

The one or more data stores 148 may correspond to one or more of volatile or nonvolatile memories such as random access memory, flash memory, magnetic memory, optical memory, solid-state memory or other devices that are operative to store circuit executable instructions and data. Circuit executable instructions may include instructions in any of a plurality of programming languages and formats including, without limitation, routines, subroutines, programs, threads of execution, objects, methodologies, scripts, applets and functions which carry out actions such as those that are described herein. Structures for processors may include, correspond to and utilize the principles described in the textbook entitled Microprocessor Architecture, Programming and Applications with the 8085 by Ramesh S. Gaonker (Prentice Hall, 2002) which is incorporated herein by reference in its entirety.

Exemplary data stores used in connection with exemplary arrangements may include any one or more of several types of mediums suitable for holding circuit executable instructions. These may include for example, magnetic media, optical media, solid-state media or other types of media such as RAM, ROM, PROM, flash memory, computer hard drives or any other form suitable for holding data and circuit executable instructions. Exemplary controllers may include other components such as hardware and/or software interfaces for communication with devices that are part of the exemplary system, and communication with external systems and devices. Further it should be understood that exemplary arrangements may include one or more controllers which are in operative connection with the devices to be controlled and/or with one another. Such controllers may be located at the site of the system. Alternatively or in addition some of the controllers may be located remotely and accessible through wired or wireless communications. Such controllers may be operated in a virtual environment or cloud based environment so as to facilitate accessibility and redundancy of the controllers and their operation. Of course it should be understood that the controller structures described are exemplary and in other arrangements other approaches and configurations may be used.

In the exemplary system a number of different sensors may be utilized for purposes of achieving desirable operational characteristics of the pump jack system. For example the exemplary system includes at least one force sensor 150. The at least one force sensor is in operative connection with the sucker rod string and is operative to detect at least one rod force which corresponds to compressive and tensile forces acting thereon. In exemplary arrangements the at least one force sensor may be arranged in line with the sucker rod string, or may be positioned in other locations in which features corresponding to forces acting on the sucker rod string may be detected.

In exemplary arrangements the system includes at least one direction sensor schematically indicated 152. The at least one direction sensor is operative to sense at least one direction feature which is indicative of a direction in which the sucker rod string is currently moving. In exemplary arrangements the at least one direction sensor may include an accelerometer or other device that is operative to determine motion of a pump jack component relative to gravity. In other arrangements the at least one direction sensor may include a suitable optical encoder or other device for detecting a feature of a component of the pump jack, the speed changing connecting drive or the gearbox that corresponds to a direction of movement of the sucker rod string.

The exemplary arrangement further includes at least one position sensor schematically indicated 154. The at least one position sensor is operative to detect at least one position feature that corresponds to a current vertical position of the sucker rod string within its range of reciprocating motion. As can be appreciated, detection of the position feature is usable to determine a current position of not only the sucker rod string but also the piston in the subsurface well pump 29. Exemplary position sensors may include optical encoders, Hall Effect sensors, or other suitable sensors and detectors for detecting indicia or properties which correspond to a position of the sucker rod string. Further as can be appreciated, in exemplary arrangements the at least one position sensor may be in operative connection with the polished rod or other components of the pump jack, or alternatively may be in connection with the gearbox or other system components from which the position feature indicative of the sucker rod string position can be determined.

The exemplary system further includes at least one speed sensor 156. The exemplary speed sensor is operative to detect the rotational speed at which at least one component in operative connection with the pump jack is moving. In the exemplary arrangement the at least one speed sensor 156 is in operative connection with the gearbox 34. The at least one speed sensor may be a suitable optical encoder, Hall Effect sensor, photosensor, cam sensor or other suitable sensor for detecting rotational speed which corresponds to the operation of the pump jack. Of course it should be understood that the sensors described in connection with the exemplary arrangement are merely examples of the types of sensors that may be utilized in systems that employ the principles that are described herein for purposes of monitoring and controlling the pump jack system.

Figure 10:
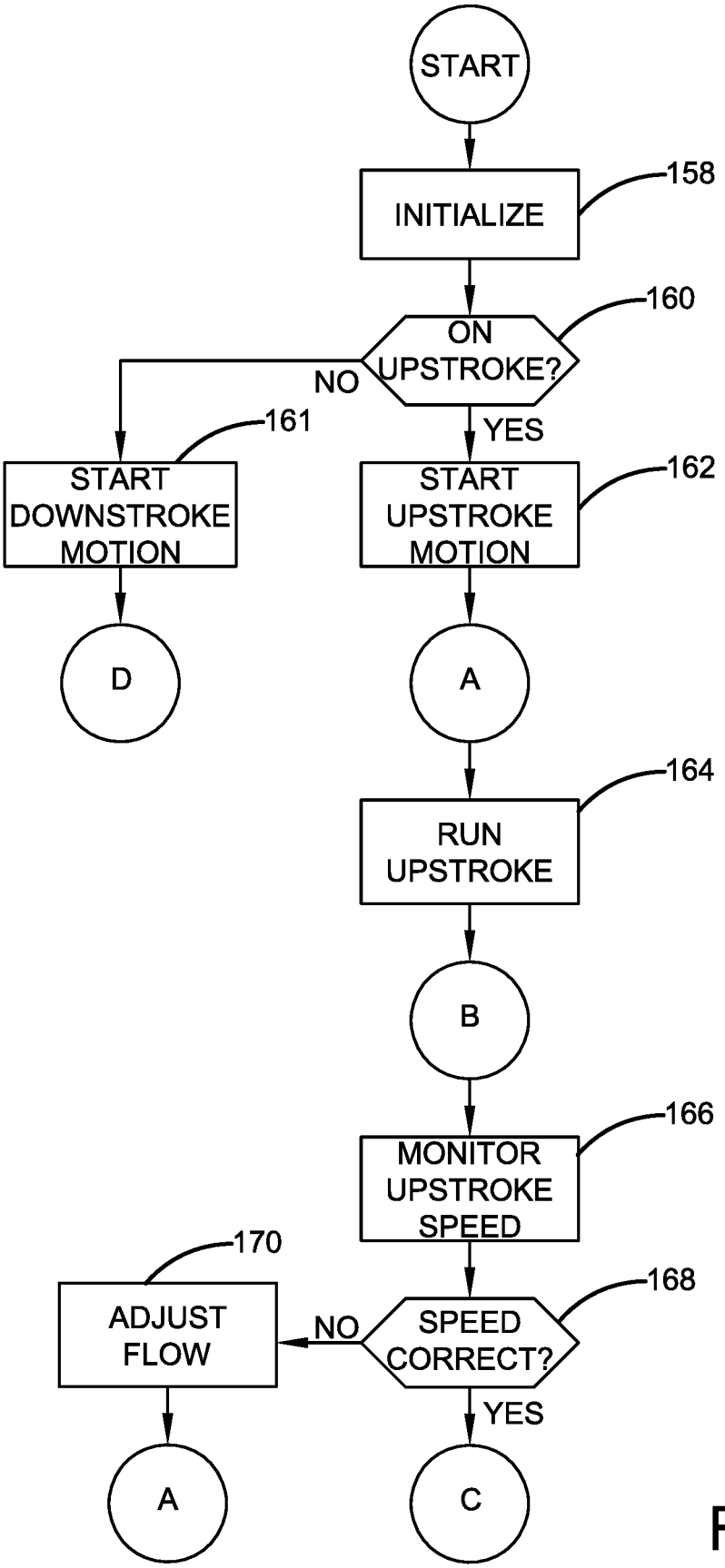
FIGS. 10-12 are a schematic representation of logic flow carried out by at least one exemplary controller in connection with controlling the speed of a pump jack.
Figure 11:
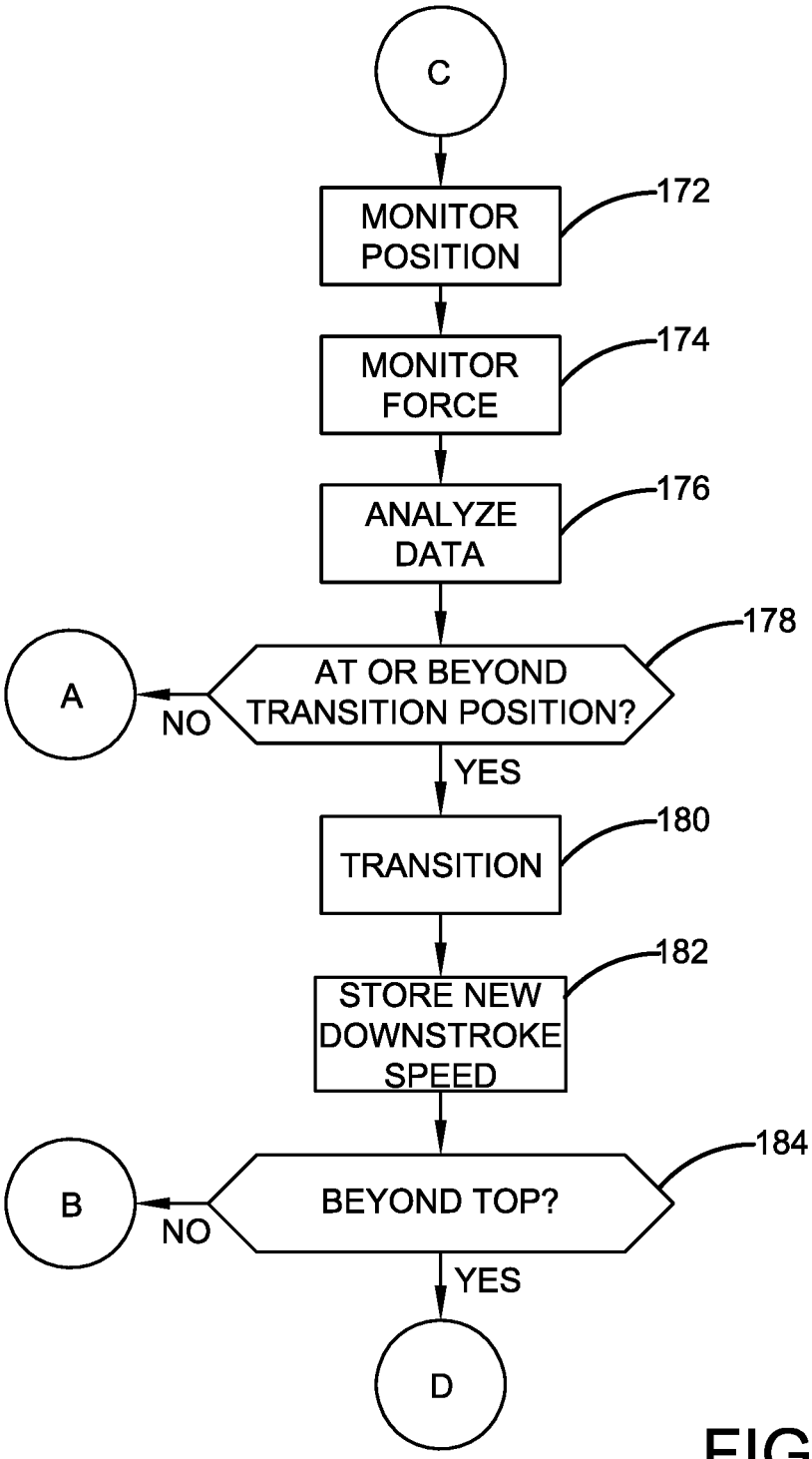
Figure 12:
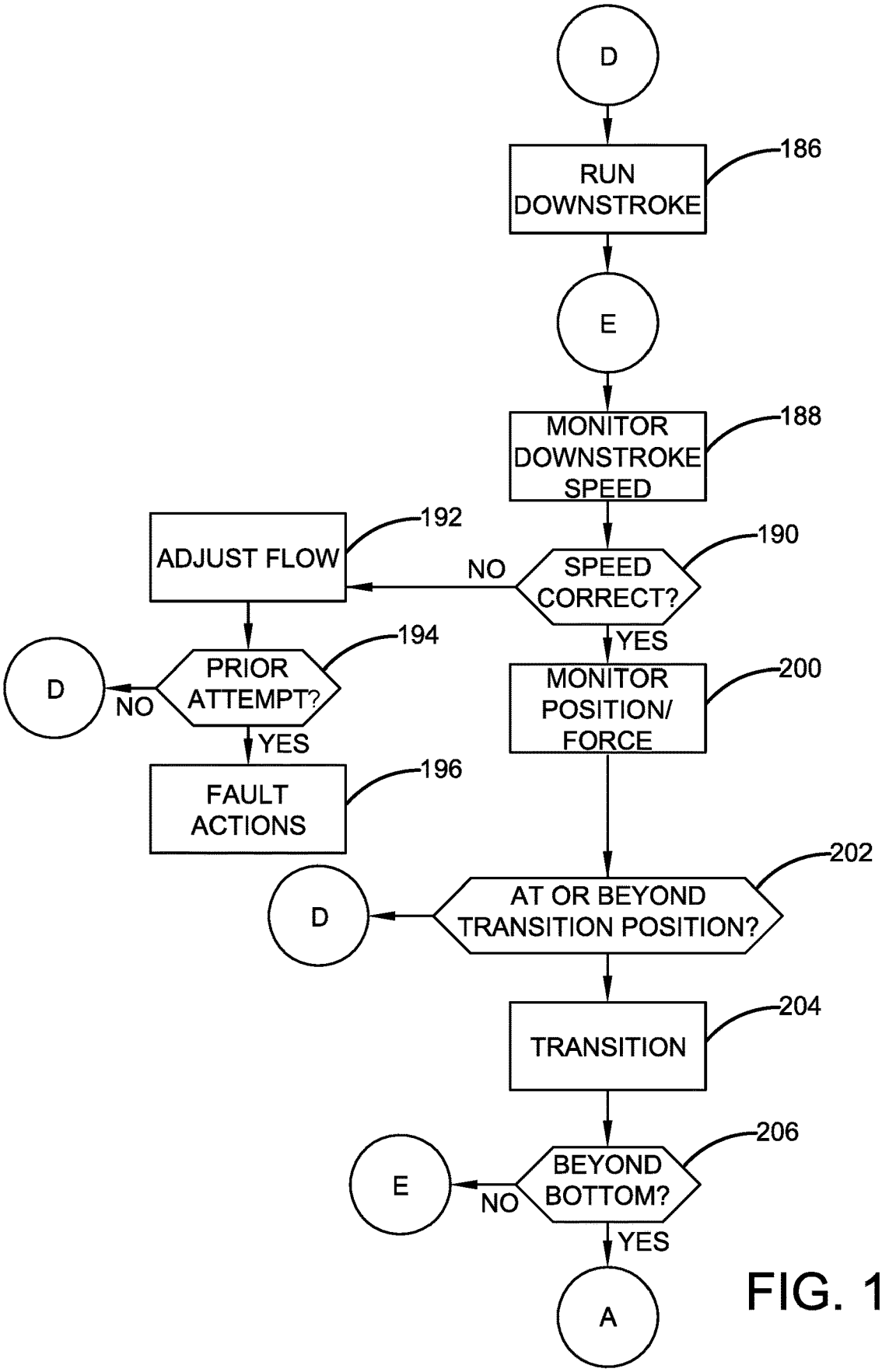

In operation of exemplary arrangements the at least one controller 144 is operative in accordance with its stored circuit executable instructions and circuitry configuration to provide accurate control of the pump jack system throughout its operating cycle. Such control facilitates providing efficient operation while reducing the risk of malfunctions and damage. An exemplary logic flow executed through operation of the at least one controller to control movement of the pump jack is represented schematically in FIGS. 10-12. In the exemplary arrangement with the commencement of operation of the pump jack the at least one controller is operative to carry out an initialization step as represented by step 158. The controller in the initialization step is operative to determine the current position of the pump jack in the course of its operating cycle. The exemplary controller performs this operation responsive to signals received from the plurality of sensors that are in operative connection with the controller. Such sensors provide signals indicative of the operational system status and which are indicative that the system is ready to commence operation. Further signals from the at least one position sensor and at least one direction sensor are utilized to determine the current position of the pump jack in its operational cycle.

Responsive to the analysis carried out by the at least one controller in the initialization step 158, the at least one controller is operative in a step 160 to make a determination as to whether the current position of the pump jack in its operating cycle corresponds to data included in the at least one data store that corresponds to the upstroke of the sucker rod string. If in step 160 the at least one controller determines that the current position of the pump jack corresponds to the upstroke portion of the cycle, the at least one controller is operative in a step 162 to commence programmed operation to begin motion of the upstroke. In the exemplary arrangement this programmed operation includes the at least one controller sending suitable signals to the control valve 66 of the pump/motor 48 to begin a controlled working liquid flow from the pump/motor liquid outlet of the pump. In the exemplary arrangement the at least one controller in the step 162 provides a smoothly increasing flow from the pump/motor which then causes the motor/pump to rotate the rotatable output coupler in the first rotational direction to drive the speed changing connecting drive and the gearbox and begin the upstroke movement.

If in step 160 the at least one controller is operative to determine that the position of the sucker rod string is not in a position considered to be part of the upstroke, the at least one controller is operative in a step 161 to commence controlled downstroke motion so as to smoothly begin sucker rod string operation in the downstroke portion of the pump jack cycle as later discussed.

Once the at least one controller has smoothly commenced upstroke motion in the pump jack cycle the controller then operates in a step 164 to cause the pump/motor 48 to deliver working liquid at a flow rate which causes the sucker rod string to move upward at an upstroke speed value corresponding to a stored value in the at least one data store 148. In exemplary arrangements the stored upstroke speed value corresponds to a speed for lifting the well liquid at a rate effective to pull the liquid upward from the pump 29 without significant loss of liquid outward from the pump into the surrounding formation. In exemplary arrangements the upstroke speed is programmably set to be a relatively fast speed compared to the speed at which the sucker rod string usually moves downward during the downstroke. Of course this approach is exemplary and in other arrangements other approaches may be used.

In the operation of the exemplary at least one controller, the controller operates in a step 166 to monitor the actual upstroke speed which is being carried out by the pump jack. This is accomplished using the signals from the speed sensor 156. A determination is made at a step 168 as to whether the speed at which the pump jack is actually moving during the upstroke corresponds to the desired programmed speed. If the determination in the step 168 indicates that the speed at which the upstroke is occurring does not correspond to the desired programmed speed, an adjustment to the working liquid flow rate from the pump/motor is made as indicated by a step 170. As the controller operates to carry out a flow adjustment in the flow rate of working liquid to adjust the speed, the signals from the at least one speed sensor are monitored to determine whether the adjustment in flow produces the desired change in speed.

After the upstroke speed is determined and corrected if necessary, the at least one controller operates to monitor the at least one position sensor 154 in a step 172 and to monitor the force on the sucker rod string detected by the at least one force sensor in a step 174. As indicated by step 176, the at least one controller is operative to analyze the force and position data to determine the amount of currently available pumpable well liquid that is available at the subsurface well pump. The at least one controller makes this calculation by adjusting signal data that is received from the at least one force sensor for factors associated with the weight and inertia of the sucker rod string and other forces that act on the at least one force sensor. The analysis is operative to determine the weight of the well liquid that is being lifted by the piston of the pump during the particular upstroke. The weight of the available pumpable well liquid may be substantially less than the weight of the well liquid that could occupy the available volume within the well pump. By determining the extent to which the well pump is filled on the upstroke the at least one controller is operative to determine if the pump jack may be operating efficiently or may be carrying out cycles in which each cycle only pumps a small fraction of the available pump capacity.

Alternatively the at least one controller may operate to determine that the well pump is full to capacity on the upstroke at the current cycle rate. In such circumstances the at least one controller may determine that the frequency of cycles may be increased to pump more well liquid upward from the well. In the exemplary arrangement the at least one controller operates in accordance with its circuit executable instructions and analysis of the available pumpable well liquid to determine the speed at which the sucker rod string and the piston should be moved downward during the downstroke so that the well pump is operated in a manner in which the available pump volume is effectively filled with well liquid which can be pumped upward on the next upstroke.

In the exemplary arrangement the at least one controller operates to monitor the vertical position of the sucker rod string to determine if the sucker rod string has reached a position in which the speed and acceleration of the pump jack should be controlled to minimize the forces which act on the sucker rod string and the pump jack as they transition from the upstroke to the downstroke. In a step 178 the at least one controller makes the determination as to whether the position of the sucker rod string is at or beyond at least one transition position at which the controller should begin reducing the upstroke speed to facilitate the transition of the pump jack to the downstroke.

If at step 178 it is determined that the sucker rod string is at or beyond the transition position at which the controller begins adjusting the speed and acceleration of the sucker rod string, the controller executes a programmed transition profile as represented in a step 180. In step 180 the at least one controller varies the flow of working liquid from the pump/motor liquid outlet in accordance with the transition profile to cause the motor/pump and the connected gearbox and pump jack, to move the sucker rod string in a manner which smoothly reduces the speed of the sucker rod string as the string approaches the top of its stroke.

Further as the upstroke is completed the exemplary at least one controller based on the analysis carried out in step 176 operates to determine a suitable downstroke speed for the sucker rod string. The suitable downstroke speed will be a speed calculated to cause the available volume of the well pump to be nearly fully occupied with well liquid when the sucker rod string reaches the fully downward position. The at least one controller causes this new calculated downstroke speed to be stored in the at least one data store as represented in a step 182.

The at least one controller continues to monitor the at least one position sensor and to determine in a step 184 when the pump jack has reached a position such that the sucker rod string is at or beyond the top position such that the pump jack is positioned to move the sucker rod string downward. The at least one controller then operates as represented by step 186 to cause the pump/motor to deliver working liquid flow at the pump/motor liquid outlet that will cause the motor/pump 38 to operate at the desired downstroke speed. In a step 188 the at least one controller is operative to monitor the downstroke speed responsive to signals received from the speed sensor 156. In a step 190 a determination is made as to whether the detected actual speed of the pump jack corresponds to the desired downstroke speed.

If in step 190 the at least one controller determines that the downstroke speed does not correspond to the desired speed, the at least one controller operates in accordance with its programming to adjust the working liquid flow rate output by the pump/motor 48. This is represented by step 192. As represented in a step 194 the at least one controller is further operative to make a determination if at least one prior attempt to adjust speed of the downstroke has been made unsuccessfully. In circumstances where the sucker rod string has become bound or stuck for example due to the formation of paraffin or other causes in the wellbore, attempts to adjust the liquid flow from the pump/motor will not result in the desired downstroke speed. In such circumstances the at least one controller is operative to execute a step 196 to take actions to identify a fault condition. In some exemplary arrangements this may include the at least one controller sending signals to cause the pump/motor to operate in a 0 flow condition. Alternatively or in addition the at least one controller may operate to give an indication of a problem through an output device either locally or remotely. This may be accomplished for example by the at least one controller providing an audible alarm from at least one of the available output devices 196. Alternatively or in addition the at least one controller may cause communications to be sent through at least one communication portal 198 to give a remote indication to a remote operator of a problem. This may include for example sending wireless communications through the antenna or satellite dish 58 previously discussed to a remote monitoring center to indicate the problem. Such communications may also include the sending of programmed information which will help the individuals responsible for monitoring the installation with an indication of the type of problem that has been encountered. Of course it should be understood that these approaches are exemplary and in other arrangements other approaches may be used.

If the sucker rod string is determined to be moving on the downstroke at the desired speed in step 190, the at least one controller continues to monitor the position and the forces acting on the sucker rod string through signals that are sent from the at least one force sensor and the at least one position sensor. This is represented by step 200. The at least one controller operates to determine when the sucker rod string has reached a position that is at or beyond a transition position at which the speed and acceleration of the sucker rod string is to be controlled to avoid excessive force as the sucker rod string undergoes the transition from the downstroke to the upstroke. The determination of whether the sucker rod string is at the transition position as represented by a step 202.

Once the at least one controller has determined that the sucker rod string is at or beyond the transition position, the at least one controller operates as represented in a step 204 to cause the speed of the sucker rod string to be controlled in accordance with a programmed transition profile. In exemplary arrangements this transition profile includes changing the working liquid flow from the pump/motor to provide the desired speed of downstroke movement of the sucker rod string so as to smoothly move through the bottom of the downstroke. This controlled movement is operative to prevent excessive inertial or other forces acting on the sucker rod string to cause excessive wear or potential damage and/or to assure that the sucker rod string does not stall or become stuck at the bottom of the downstroke. In some circumstances the transition profile may include a controlled slowing of the downstroke speed while in other circumstances the transition profile may include an increase in speed.

As represented in a step 206 the at least one controller is operative responsive to the at least one position sensor to determine if the sucker rod string is at or beyond the bottom of its movement. Responsive to this determination at least one controller is operative to cause the controller to return to operation responsive to the upstroke instructions previously discussed so that the well liquid that has been collected in the well pump can is pumped upward. The at least one controller repeats the cycle so as to carry out the pumping action in a controlled manner without causing excess wear or possible damage to components of the system.

In the exemplary arrangement the at least one controller is operative in accordance with its circuit executable instructions, to maintain pump jack operation rather than stop operation entirely as may be done by other systems, when there are small available amounts of pumpable well liquid. Stopping the reciprocated motion of the pump jack and the sucker rod string can result in the sucker rod string and/or the piston of the pump becoming stuck or bound. Such conditions may result from the infiltration of material and/or the formation of waxes, paraffins or other substances in the wellbore which restrict movement and/or the flow of well liquid. The exemplary arrangement is programmed to continue pump jack operation with the sucker rod string moving more slowly during the downstroke to at least the point of the transition profile previously discussed. By maintaining continued movement of the sucker rod, conditions such as sticking and binding that may cause damage to the system are less likely to be encountered. Thus in the absence of detecting conditions which corresponds to a fault or malfunction, the exemplary at least one controller is operative to continue pump jack operation at a relatively slow cycle speed when small amounts of pumpable well liquid are available.

In the exemplary arrangement as the pump jack goes through its cycle the working liquid flow rate from the pump/motor and the speed of the gearbox and the pump jack are controlled in a manner that varies in accordance with the position of the sucker rod string and the pump jack in the cycle, as well as the programmed upstroke and downstroke speeds for purposes of efficient and reliable pump jack operation. During the pump jack cycle the exemplary at least one controller is operative to cause the driver to operate at a generally constant rotational speed. This constant rotational speed provides sufficient power on the power curve of the driving device to deliver the power to the pump/motor needed for operation of the system while at the same time providing economical and efficient operation of the driver. The speed of the driver may be controlled by the at least one controller communicating with an electrical control module of the engine. By having the driver generally operate at a constant operational speed, and working liquid flow being varied as desired through operation of the control valve 66, excessive wear that comes from variation and/or extremes of speed of the driver are avoided. Further in exemplary arrangements fuel-efficient operation is achieved by the operation of the driver. For purposes hereof a generally constant speed shall be considered to be a rotational speed in the driving direction that is no more than 25% above or below the desired fixed rotational speed. In exemplary arrangements the rotational speed of the driver is maintained at no more than 10% above or below the desired rotational speed. For example in some exemplary arrangements the driver may comprise a relatively slow speed internal combustion engine that operates using well gas as a fuel. The speed of the driver is maintained at a generally constant speed. The output speed from the driver is increased by transmission through the speed changing connecting drive 43 to a higher speed at which the pump/motor 48 is driven. The corresponding generally constant speed of the pump/motor provides the suitable pressure and range of flow rates for operation of the motor/pump. In exemplary arrangements the pump/motor operates at a generally constant speed of 1500 rpm. Of course it should be understood that this approach is exemplary and other arrangements other approaches may be used.

The reciprocating operation of the pump jack causes during at least some cycles, a return force to be applied by the pump jack through the gearbox to the motor/pump 38. This return force may result from force applied by the at least one counterweight during portions of the pump jack cycle as the counterweight vertically reciprocates. Return force may also result from the weight of the rod string, inertial forces or other forces from the pump jack components or the movement thereof. The return force acting through the gearbox and the drive 41 in the exemplary arrangement urges rotation of the output coupler 40 in the first rotational direction. The return force further causes the motor/pump 38 to act as a pump such that the return force urges return working liquid flow from the motor/pump liquid outlet, through the motor/pump output liquid line and to the pump/motor liquid inlet. The return force increases the pressure force of the return working liquid at the pump/motor liquid inlet, which urges the pump/motor to rotate in the driving direction. The return liquid assists the operation of the driver in rotating the rotatable input coupler during pump/motor operation. As a result the amount of energy required to be delivered from the driver is reduced during the overall operation of the pump jack system. This results in increased efficiency and less wear of driver components and other system components.

Further it should be understood that while in the exemplary arrangement the principles described are applied to a rocking pump jack system, in other arrangements the principles may also be applied to other types of systems that are operative to move a vertically reciprocating sucker rod string. Such other types of systems shall also be considered a pump jack for purposes hereof. The application of these principles result in improved system operation, greater energy efficiency and reduced risk of failure.

Figure 9:
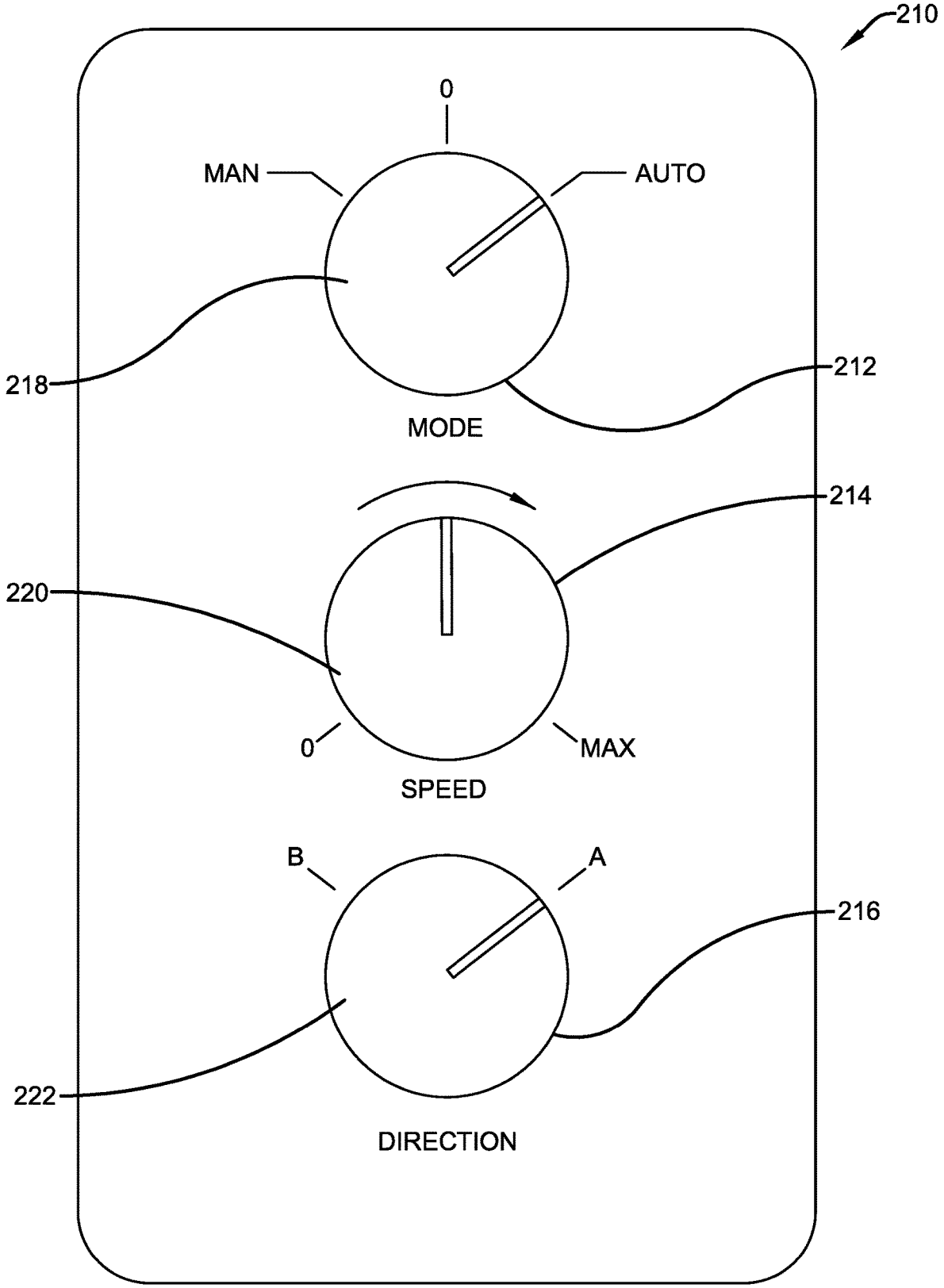
FIG. 9 is a view of exemplary user input devices in operative connection with an exemplary controller.

In an exemplary arrangement the at least one controller 144 is in operative connection with a plurality of input devices 208. Some exemplary input devices are usable in some arrangements to provide input signals from automated devices to the at least one controller. Other exemplary input devices comprise manual input devices which are operable to receive manual inputs from system operators. FIG. 9 shows an exemplary control panel portion 210 that includes manual input devices 212, 214 and 216. It should be understood that while these manual input devices are represented by manually rotatable knobs, in other arrangements the manual input devices may be of other types such as switches, slides, levers or other manually movable structures.

Input device 212 includes a manually rotatable knob 218. Knob 218 is in operative connection with at least one electrical switch which is in operative connection with the at least one controller. The knob is manually movable to three selectable positions. In the position shown, the pointer indicia on the knob indicates that the knob is set to a rotatable position in which the at least one controller causes the system to operate in AUTO or automatic mode. In the automatic mode of the exemplary arrangement the at least one controller operates the pump/motor responsive to its associated programmable circuit executable instructions such as those previously discussed in connection with FIGS. 10-12.

Manual rotation of knob 218 counterclockwise from the AUTO position shown in FIG. 9 to the 0 position is operative to cause the at least one controller to no longer control flow rate operation of the pump/motor. Rather in this position the pump/motor operates to output a 0 flow rate at the pump/motor liquid outlet. As a result no working liquid is delivered from the pump/motor to the motor/pump and the pump jack is held stationary. Also it should be noted that in this position the lockout valves 74, 76 may be manually closed to hold the gearbox and the pump jack in a fluid locked condition. It should be appreciated that in this 0 position the driver may continue to deliver rotational energy to the pump/motor such that the driver does not have to be shut down even though the pump/motor is operating to deliver a 0 flow rate of working liquid.

Manual movement of the knob 218 further counterclockwise from the 0 position to the position labeled MAN, is operative to enable manual control of the flow rate of working liquid from the pump/motor liquid outlet. In this position of knob 218 manual input device 214 is operative to set the flow rate of working liquid delivered from the pump/motor liquid outlet.

Manual input device 214 includes a knob 220. Manually changing the rotational position of the knob is operative to cause the controller to operate the pump/motor to selectively deliver working liquid at a fixed flow rate anywhere within the range from the 0 flow rate to the maximum flow rate depending on the rotational position of knob 220. In the exemplary arrangement the knob 220 is in operative connection with a potentiometer or other rotational position indicating device that delivers signals to the controller which are indicative of the rotational position of the knob.

During operation in the manual mode, placing the pointer indicia on the knob 220 in alignment with the 0 mark on the panel causes the controller to control the pump/motor to provide a 0 flow rate. Rotating the knob 220 to an intermediate location between the 0 mark and the MAX mark, is operative to cause the at least one controller to provide working liquid flow at a fixed flow rate corresponding to the rotational position of the knob along the continuous range of available flow rates. Manually moving the knob 222 the position corresponding to the MAX mark, causes the controller to operate the pump/motor at the maximum working liquid flow rate.

This exemplary arrangement enables an operator to manually position the knob 220 and cause the pump/motor to deliver working liquid flow at any desired flow rate, and thereby cause the motor/pump, gearbox and pump jack components to move at constant desired speed anywhere in the continuous range of available flow and corresponding speeds. This feature may be particularly useful when performing testing and service activity on components of the pump jack. For example, it may be necessary during some testing and service activity to move the pump jack components at a very slow speed and/or to stop all movement with a component in a particular position. The exemplary manual input device 214 enables an operator to carry out these functions. Of course this approach is exemplary and in other arrangements other approaches may be used.

Figure 16:
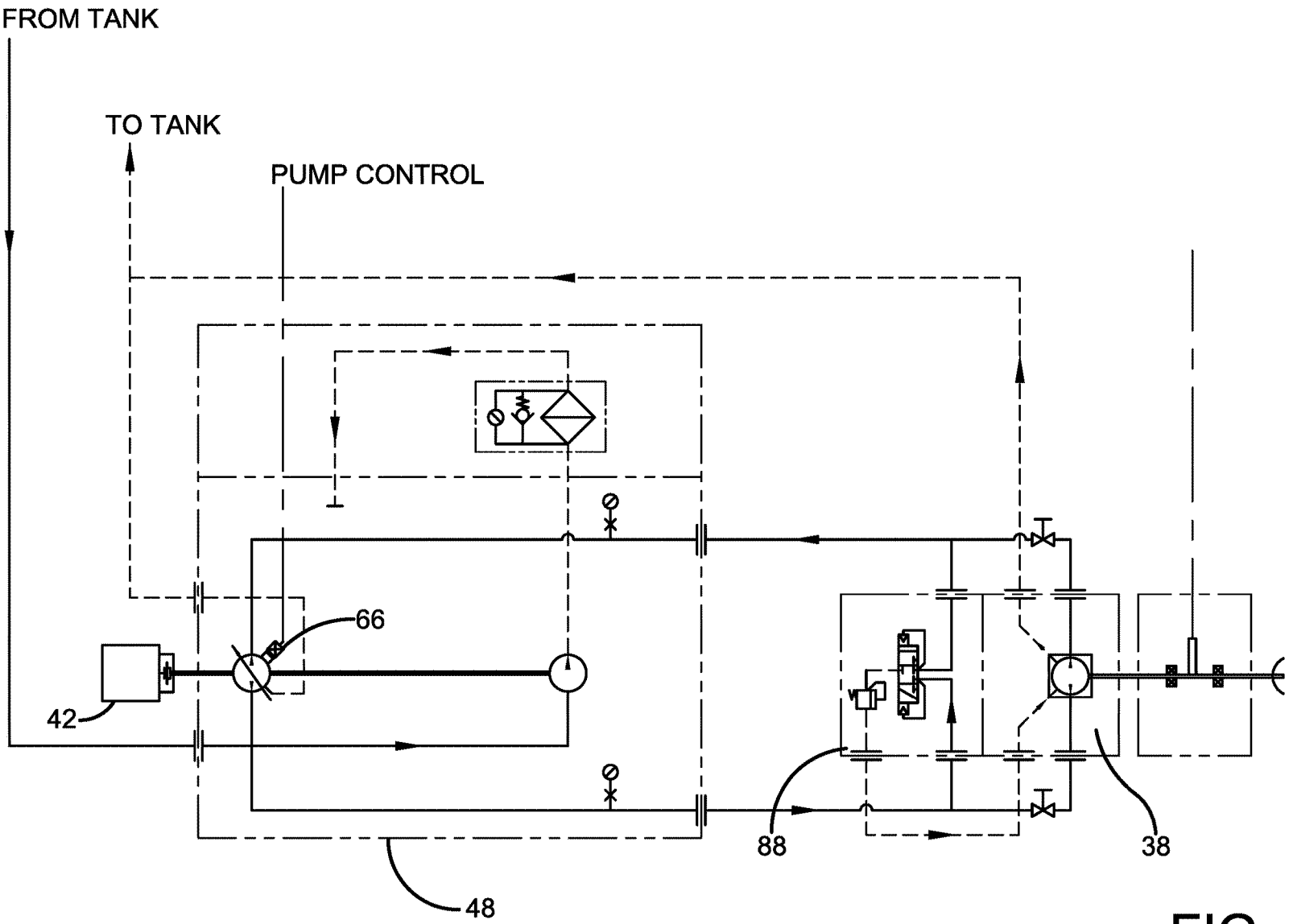
FIG. 16 is a view similar to FIG. 2 schematically showing the flow of working liquid in an opposed direction from the flow shown in FIG. 2.

As previously mentioned, the ability of the pump/motor to deliver working liquid in either flow direction provides the capability of the exemplary arrangements to operate the pump/motor in a reverse flow direction from that shown in FIGS. 1 and 2. In the exemplary arrangement the angular position of the swash plate in the pump/motor can be moved responsive to signals to control valve 66 from the at least one controller, to an opposite angle from that of the swash plate during the operation as shown in FIGS. 1 and 2. Operating the pump/motor to operate in this manner results in the flow of working liquid that is shown in FIG. 16. Although the driver 42 continues to drive the input coupler of the pump/motor 48 in the driving direction, what was previously the pump/motor liquid inlet now operates as the pump/motor liquid outlet. Likewise what was previously the pump/motor liquid outlet becomes the pump/motor liquid inlet.

Correspondingly the motor/pump 38 is subject to a reverse flow from that represented in FIGS. 1 and 2. In this reverse flow direction, what was previously the motor/pump liquid outlet becomes the motor/pump liquid inlet. Likewise what was previously the motor/pump liquid inlet becomes the motor/pump liquid outlet. This results in the output coupler of the motor/pump operating in a second rotational direction which is the opposite of the first rotational direction. However as can be appreciated because the reciprocating motion of the walking beam is the same regardless of the rotational direction of the crank arm, the pump jack operates substantially the same regardless of the flow direction of the working fluid. Further in the exemplary arrangement the shuttle valve 88 is configured to change flow direction such that liquid is drawn from the line through which the return liquid from the liquid outlet of the motor/pump moves towards the pump/motor liquid inlet. Further during operation in this reverse direction the closed liquid connections between the pump/motor and the motor/pump are maintained.

The exemplary manual input device 216 enables a user to selectively determine the direction of flow of the working liquid between the pump/motor and the motor/pump. Input device 216 includes a knob 222. By manually positioning the pointer indicia on the knob 222 the user is enabled to select the direction of working liquid flow, which also selects the direction of rotation of the rotatable output coupler of the motor/pump 38. Knob 222 is in operative electrical connection with the at least one controller 144. In the exemplary arrangement when the pointer indicia on the knob is pointed to the A mark, working liquid flows in the manner indicated in FIG. 2. Changing the knob 222 so that the pointer indicia is directed to the B mark, causes the controller to execute steps so as to assure that movement of system components is safely stopped and then restarted through flow of the working liquid in the opposed direction as shown in FIG. 16. Of course it should be understood that this arrangement is exemplary and in other arrangements other approaches may be used.

The ability of exemplary arrangements to operate with working liquid flow in either direction is used provide certain advantages in operation of the pump jack system. These advantages include that the system may be periodically changed between operating the gearbox 34, the drive 41 and the pump jack responsive to the rotatable output coupler of the motor/pump rotating in the first rotational direction and in the opposed second rotational direction. Periodically changing the rotational direction of the gearbox and other connected components enables the equalization of wear patterns on gears in the gearbox and other connected components. The ability to reverse the rotational direction and location of forces that act on the various pump jack and gearbox components enables equalization of wear patterns and prolonged component life.

A further advantage of an exemplary arrangement is that the exemplary control valve 66 includes different electrical and other components which are utilized depending on the direction of flow of the working liquid through the pump/motor 48. In the event that the electrical or other components associated with operation in one liquid flow direction should fail, the exemplary control valve may operate satisfactorily to provide flow of the working liquid in the opposed direction. Thus this capability to reverse the working liquid flow in the event of a partial control valve failure may enable the pump jack system to continue to operate despite the partial control valve failure.

Figure 15:
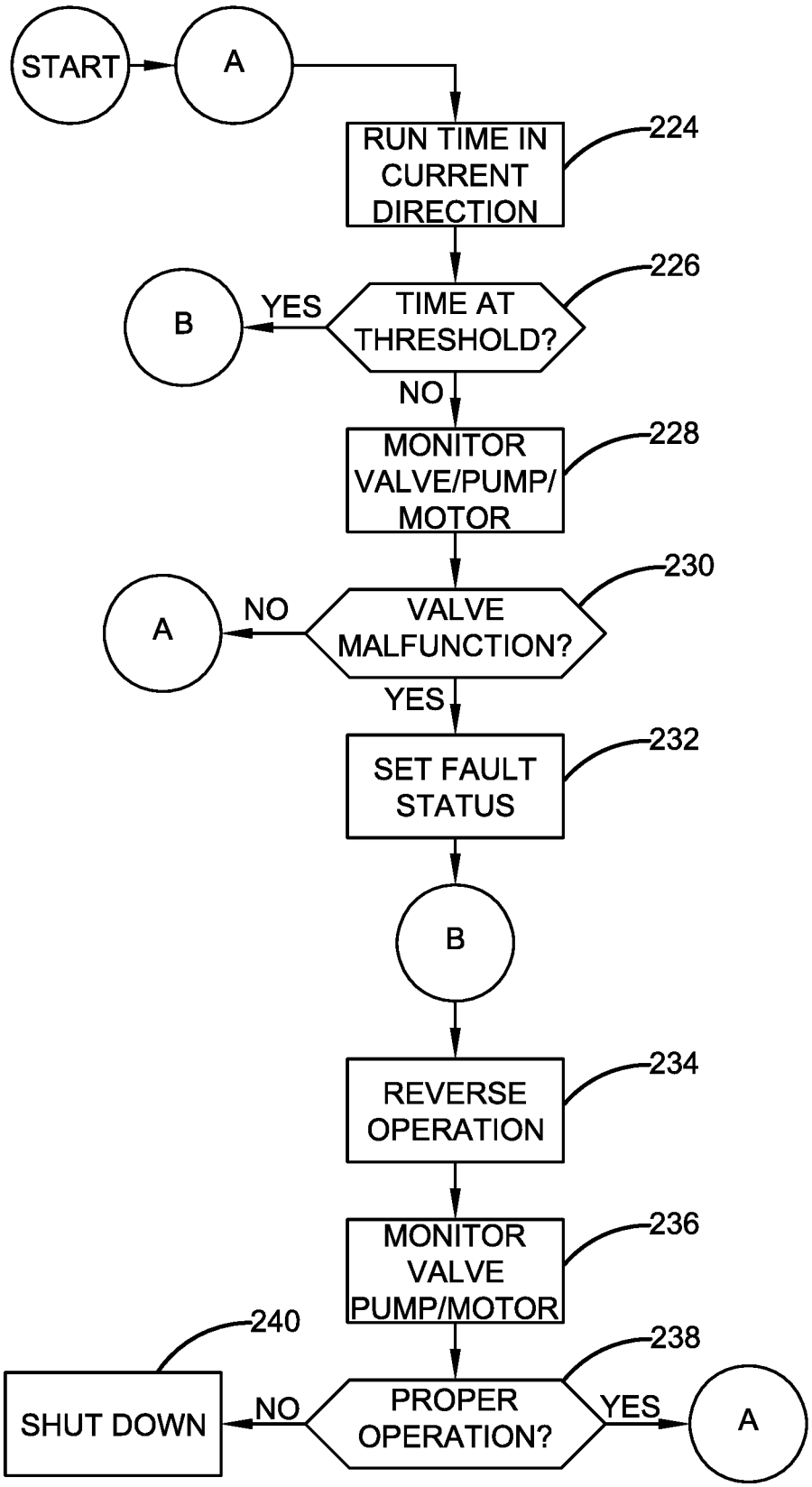
FIG. 15 is a schematic representation of logic flow carried out by at least one exemplary controller in determining a malfunction associated with a control valve that is operative to control the rate of working liquid flow through the pump/motor, and reversing flow to work around the malfunction and/or to balance wear on system components.

FIG. 15 shows schematically exemplary control logic carried out by the at least one controller in connection with operation of the pump/motor 48 and the pump jack system in reversing the direction of flow of the working liquid on a periodic basis to reduce the effects of wear on system components and to maintain operation in response to certain control valve failures. As represented by a step 224 the at least one controller is operative to determine the run time that the pump jack system has operated in the then current liquid flow arrangement since the time of the last reversal. This calculation may be based on the number of hours of continuous operation in some arrangements. In other arrangements the calculation of the run time may be based on the number of pump jack cycles that the system has carried out. In other exemplary arrangements the calculation may be based on a combination of these and/or other properties.

The exemplary at least one data store includes at least one threshold corresponding to the run time after which the direction of the working liquid flow should be reversed. In a step 226 the at least one controller is operative to determine if the amount of run time has reached the threshold at which the direction of working liquid flow should be reversed. If the threshold has not been reached, the at least one controller continues the logic flow. If the threshold has been reached the at least one controller operates to reverse the direction of the working liquid flow as later discussed.

If the run time threshold has not been reached, the at least one controller operates to monitor the operation of the control valve 66. This is represented by step 228. The valve is monitored for purposes of verifying that the valve is operative to control the flow of the working liquid through the pump/motor 48 in the manner that is appropriately responsive to the signals received by the control valve from the at least one controller. The at least one controller is operative to determine if a valve malfunction has occurred based on the performance of the motor/pump responsive to the control valve. This determination of a valve malfunction is represented by a step 230.

In the event that a control valve malfunction is determined at the step 230 the at least one controller is operative to set a fault status as represented by a step 232. In setting the fault status the at least one controller is operative to carry out programmed steps that are appropriate for the nature of the malfunction. This may include for example, providing a visual or audible output through at least one output indicator to advise a local operator of a problem with the system. Alternatively or in addition the at least one controller may operate to cause at least one message to be sent through the wireless portal to provide an indication remotely of the problem with the system. Different or other steps may be taken by the at least one controller responsive to the determination of a malfunction.

The at least one controller then operates to attempt operation of the system in the reverse working liquid flow configuration. This is represented by step 234. In the exemplary arrangement in the step 234 the at least one controller is operative to determine the current cyclical condition of the pump jack and other system components and to achieve a safe cessation of the current motion thereof. The at least one controller then operates to send signals to the control valve to initiate working liquid flow in a direction that is opposite to that which had been previously carried out. The at least one controller operates to slowly start the reverse direction flow in a manner appropriate for commencing motion of the pump jack system components. This may correspond to actions that are taken by the at least one controller in connection with a system startup and/or may include different or additional steps.

Once the controller is operating to control the control valve 66 to provide working liquid flow in the opposed direction, the operation of the valve and pump/motor is monitored to assure that the control valve and pump/motor are operating in the manner that corresponds to the signals from the at least one controller. This is represented by step 236. A determination is then made by the at least one controller as represented in a step 238 as to whether the control valve and pump/motor are operating appropriately to provide working fluid flow in the reverse direction. If so the controller continues operation of the system in the reverse working fluid direction to maintain pump jack operation. Alternatively if in step 238 it is determined that the control valve and pump/motor are not working properly, the at least one controller is operative to cause a controlled system shutdown. This is represented by step 240. The exemplary controlled system shutdown may include taking steps to secure the system until repairs can be conducted. The steps may also include taking further programmed steps so as to communicate through output devices or through the wireless communication portal with local and/or remote operators that the system has experienced a malfunction and will enter a shut down condition. Of course it should be understood that these approaches are exemplary and in other arrangements other approaches may be used.

Figure 17:
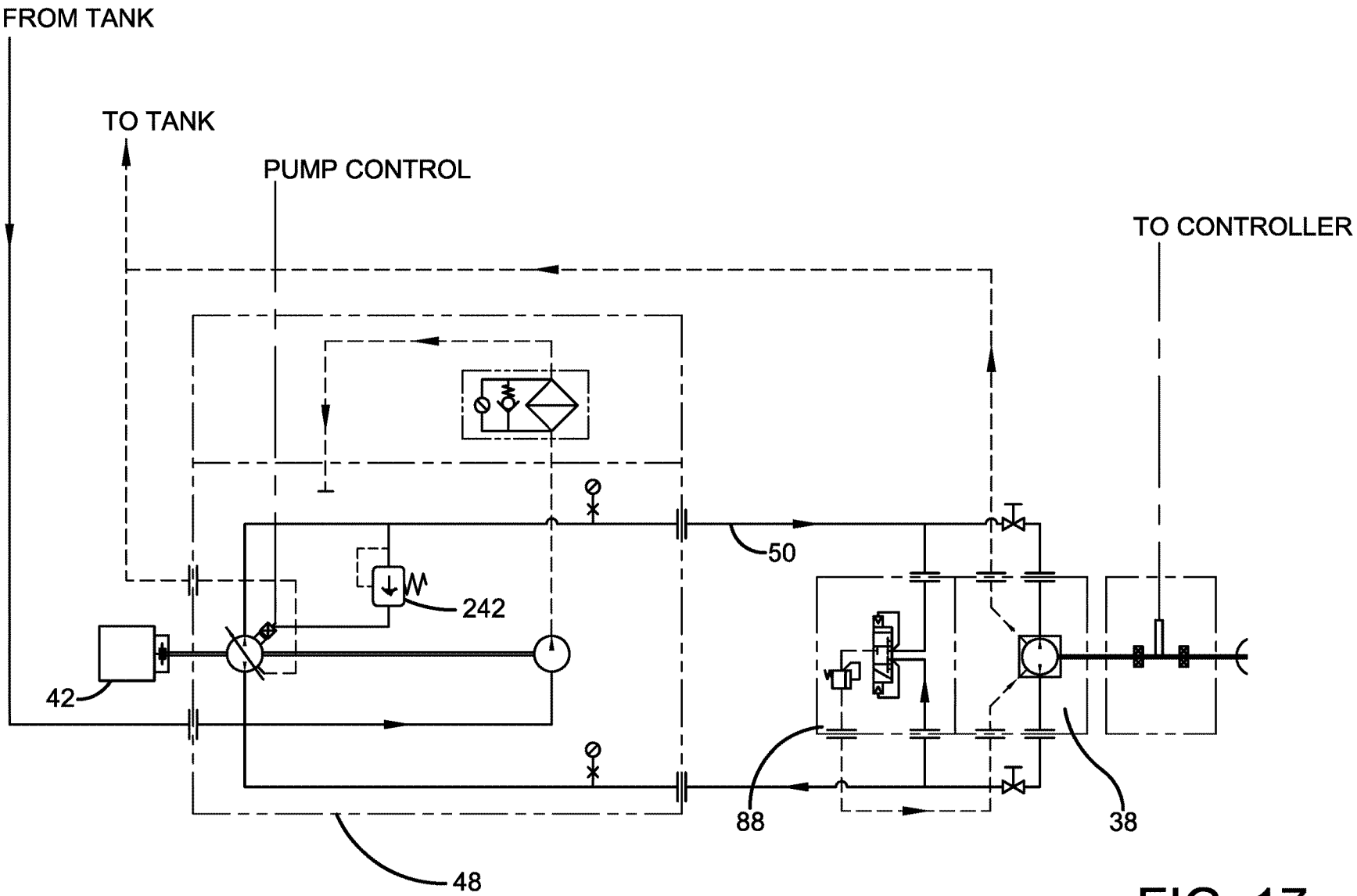
FIG. 17 is a schematic view of a system schematically showing the flow of working liquid with features that automatically hydraulically stop the flow of working liquid from the pump/motor responsive to a malfunction such as the sucker rod string becoming stuck in position.

The exemplary arrangement also provides further features to prevent damage to system components in the event of a malfunction or other conditions that cause the pump jack the stop operating. This may include for example, guarding against conditions which cause the sucker rod string to become stuck or other moving components to become immovable. As represented in FIG. 17 the exemplary system includes features in the hydraulic flow circuitry that cause the pump/motor to be placed in a 0 flow condition in the event that restricted flow from the pump/motor liquid outlet causes pressure to rise above a set limit. In FIG. 17 the direction of working liquid flow is the same as represented in FIG. 2. A pressure relief valve 242 is in operative fluid connection with the pump/motor liquid outlet and the pump/motor output liquid line 50. During normal operation the working liquid pressure at the pump/motor liquid outlet and in line 50 is below the threshold of the pressure relief valve 242. Under these conditions the system operates in a manner like that previously discussed in connection with FIGS. 1 and 2.

In the event that the sucker rod string becomes stuck or is otherwise rendered substantially immovable, or other conditions occur which prevent rotation of the walking beam, the crank arm, the gearbox, the drive or the motor/pump, the pressure at the pump/motor liquid outlet and in the pump/motor outlet line will rise. When the pressure rises to the threshold for the relief valve 242, working liquid is delivered to the control valve 66 in a manner which causes the swash plate to move to the 0 flow condition. Thus in the exemplary arrangement the driver and the pump/motor 48 continue to operate at a 0 flow condition without causing damage or breakage to components of the pump jack system. In the exemplary arrangement this protection can supplement the operation of the at least one controller to reduce the risk of possible damage to the system when problematic events and conditions occur. Of course it should be understood that this approach is exemplary and in other arrangements other approaches may be used.

Figure 13:
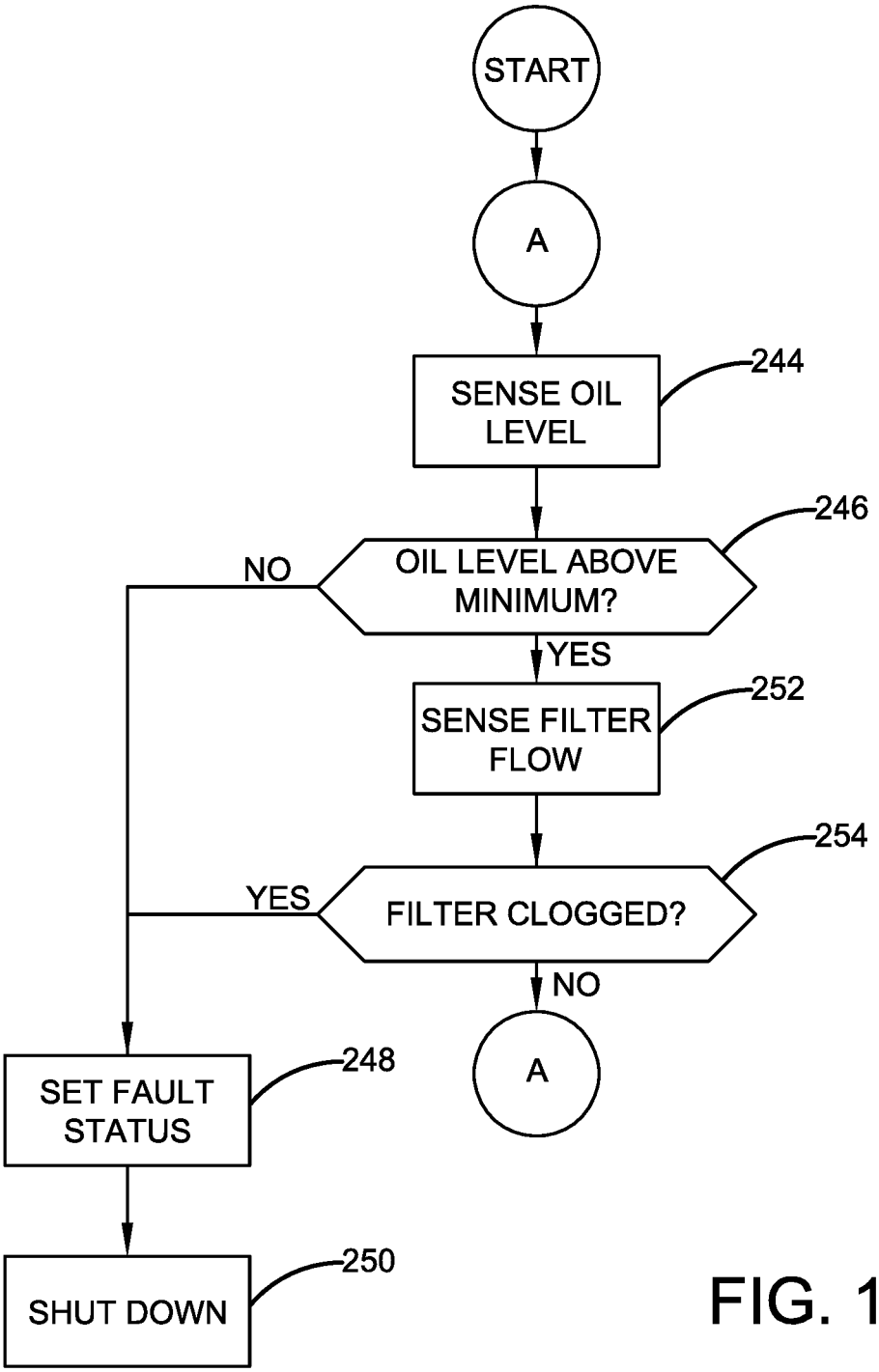
FIG. 13 is a schematic representation of logic flow carried out by at least one exemplary controller in connection with monitoring the amount of working liquid and the flow of such working liquid through a filter in the exemplary arrangement.

The at least one controller of the exemplary arrangement further operates to provide protections for the system components. FIG. 13 schematically represents the logic flow carried out by the at least one controller to assure that the pump/motor 48 is supplied with adequate working liquid for proper operation. In the exemplary arrangement the at least one controller is operative to receive signals from the oil level sensor 118 located in the tank 114. The at least one controller monitors the level of the working liquid as represented in a step 244. In a step 246 the at least one controller is operative to determine whether the detected level of the working liquid in the tank is above the minimum threshold. If the oil level has fallen to below the threshold the at least one controller is operative to set a fault status as represented in a step 248. In exemplary arrangements setting the fault status may include providing visual and audible indications from output devices in operative connection with the at least one controller to advise the user of the fault status. Further in exemplary arrangements the at least one controller may operate to send messages through the wireless communication portal 198 to a remote operator or monitoring center to indicate the fault status. The at least one controller then operates as represented by step 250 to carry out a system shutdown in a safe manner. This may include taking steps like those previously discussed to stop the movement of system components, stop flow from the pump/motor, shutdown the driver, and/or take other steps to place the system in a non-operating condition.

During normal operation the at least one controller is further operative to monitor signals from the at least one filter sensor 105. This is represented by step 252. In a step 254 the at least one controller is operative to analyze the signals from the at least one filter sensor to determine if the signals correspond to restricted flow which is indicative that flow through the filter is unduly restricted or that the filter is clogged or is near clogged so as to prevent the flow of working liquid therethrough. Responsive to the determination that the flow through the filter is unduly restricted the at least one controller is operative to set a fault status as appropriate for the filter clogged condition in the step 248 and to carry out a system shutdown in accordance with step 250. In this manner the exemplary arrangement is operative to avoid attempted system operation under conditions that may cause damage to the pump/motor and other system components.

Exemplary arrangements further include the capability for the system that has been in a shut down condition to provide for the working liquid to reach a suitable operating temperature before attempting pump jack operation. Such capabilities may be valuable in situations where the working liquid is exposed to low temperatures which may impede working liquid flow which may cause damage within the system. For example working liquid at a unduly low temperature may not freely pass through the heat exchanger, the filter or other components which include flow restrictions. In order to address the situation the at least one controller of the exemplary system is in operative connection with the working liquid temperature sensor 116 which in the exemplary arrangement is positioned within the tank 114. The at least one data store in operative connection with the at least one controller includes stored program data corresponding to at least one threshold below which the working liquid requires heating in order to be safely circulated in the system. As represented by a step 252 in FIG. 14, the at least one controller monitors the working liquid temperature as represented by a step 252 and makes a determination at a step 254 as to whether the working liquid temperature is below at least one temperature threshold.

If it is determined by the at least one controller in the step 254 that the working liquid is above the first threshold, then the at least one controller determines that the working liquid is sufficiently warm to commence normal system operation. Responsive to this determination the at least one controller is operative to commence system startup and operate the system in a normal operational mode as represented by step 256.

Alternatively if in step 254 the at least one controller is operative to determine that the working liquid temperature is below at least one threshold, the controller operates in accordance with its programmed circuit executable instructions to cause the system to initiate operation in a warm up mode so that the working liquid temperature can be increased to a level at which it is safe to commence normal system operation. Responsive to the determination that the working liquid needs to be warmed up in the step 254 the at least one controller is operative to control the position of the bypass valves 124, 126 so that the working liquid is prevented from passing through the heat exchanger and the filter. The bypass valves are controlled so that working liquid from the line 87 is directed through the bypass line 122 directly to the tank 114. This is represented by a step 258.

Figure 14:
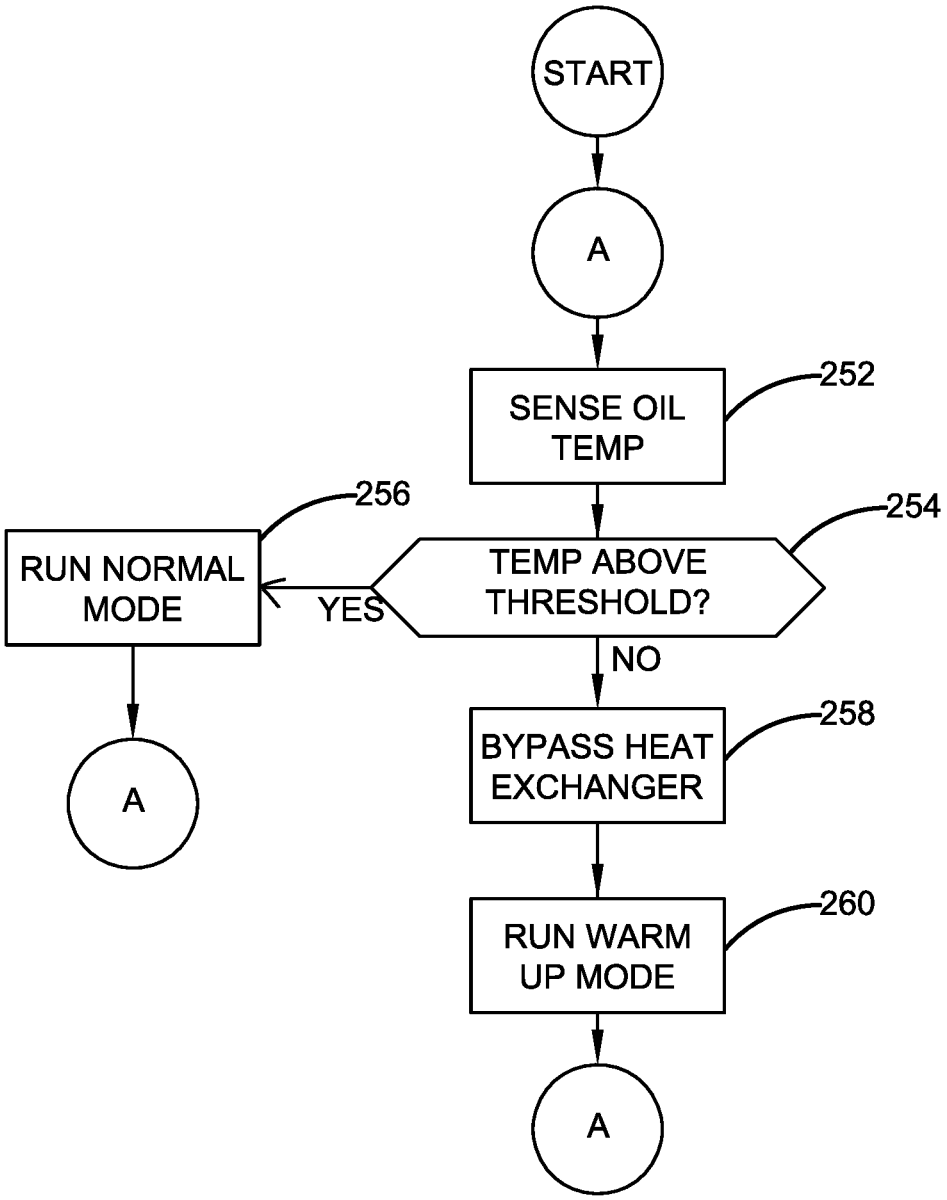
FIG. 14 is a schematic representation of logic flow carried out by at least one exemplary controller in determining temperature of the working liquid and operating the system components in a warm-up mode until the working liquid has reached a suitable operating temperature.

The at least one controller 144 is then operative to cause the pump/motor 48 to begin operation with a 0 flow rate at the pump/motor liquid outlet. This causes the flow of working liquid through the auxiliary pump 92 of the pump/motor, which causes some liquid flow through the pump/motor case 62 and through the line 87 to the tank 114. In this warm up mode working liquid from the tank passes through the auxiliary pump. This cyclical flow through the auxiliary pump and the tank causes warming of the working liquid. This operation is represented in FIG. 14 by a step 260.

The at least one controller operates the pump/motor in the warm up mode until it is determined in the step 252 that the working liquid temperature is at least at a second threshold. The second threshold may be the same as the first threshold or alternatively in some arrangements the second threshold may be a temperature level that is different than the temperature level from the first threshold determination which causes the controller to operate the system in the warm up mode. For example in some exemplary arrangements the at least one controller may operate the system so that the working liquid is at a higher second threshold to initiate normal operation than the first threshold because the working liquid in the remainder of the system is likely to be at a low temperature and may need to be exposed to warmer working liquid in order to quickly heat up the working liquid and other components to run properly. Of course this approach is exemplary and in other arrangements other approaches may be used. Once the at least one controller determines that the working liquid temperature is at the threshold for normal operation the at least one controller causes the system to commence normal operation as represented by the step 256. Of course it should be understood that in other arrangements other approaches may be used.

In alternative exemplary systems a heat exchanger for the working liquid that utilizes electrical power for purposes of operating a fan may not be desirable. This is because in certain systems the electrical power needed to operate one or more fans at a suitable air flow rate to provide the desired level of cooling may not be available. Alternatively and/or in addition, producing the electrical energy necessary to operate the one or more cooling fans to provide the desired cooling of the working liquid may in itself produce excessive heat from certain components and/or may cause inefficiencies that are undesirable.

Figure 18:
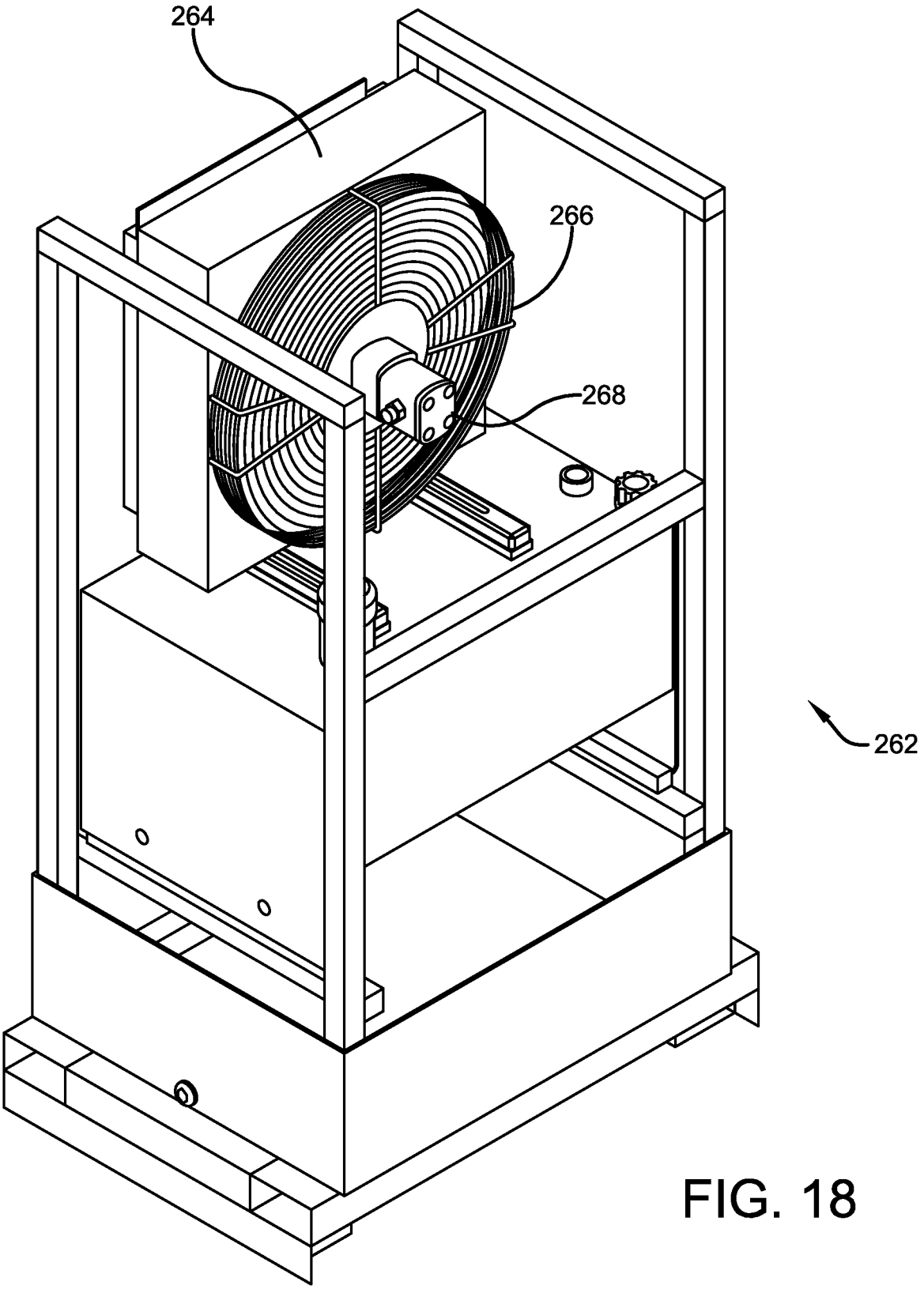
FIG. 18 is a back top rear perspective view of an alternative control stand without a roof and including a fan for moving air through an air/liquid heat exchanger that is powered by working liquid.
Figure 19:
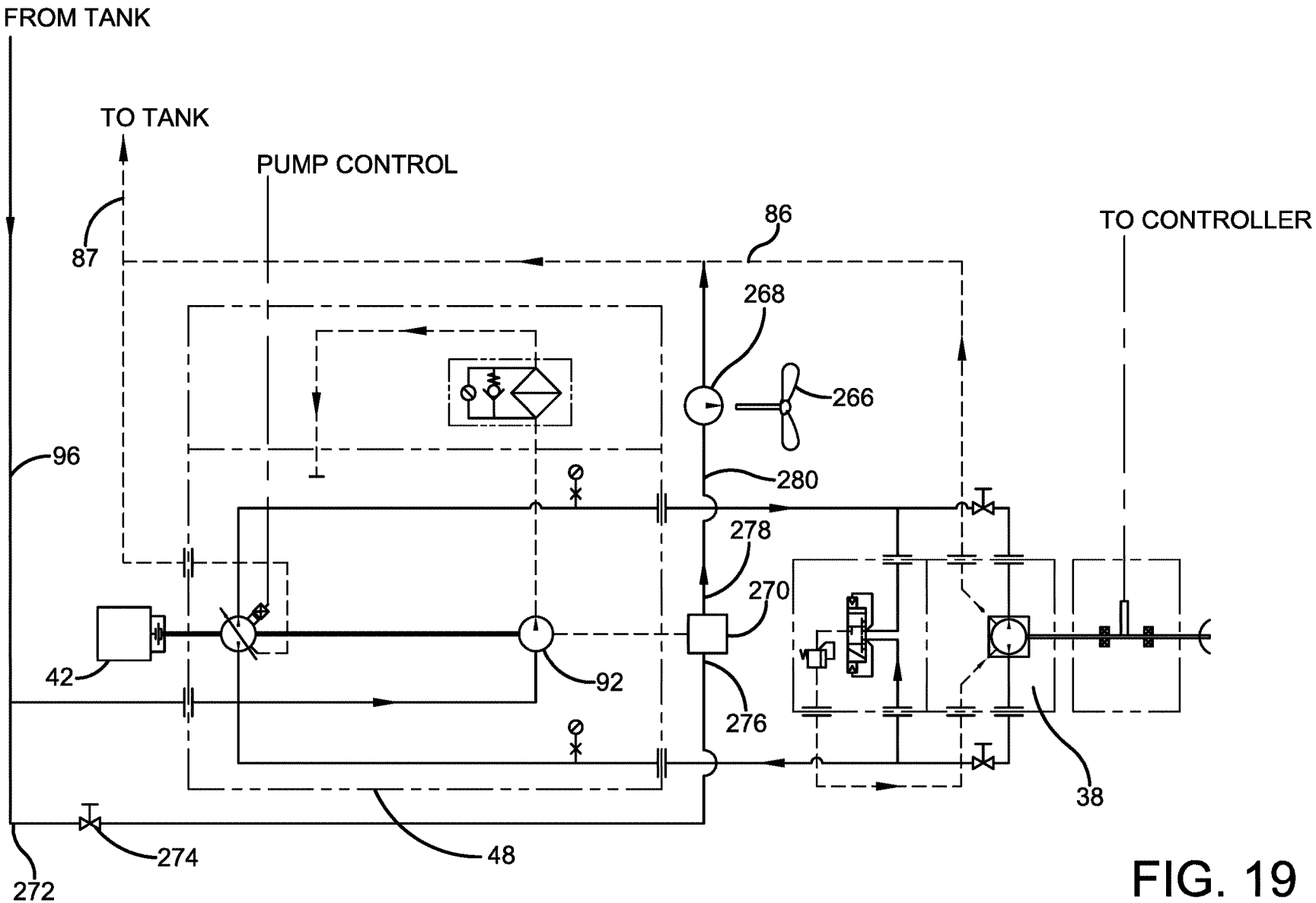
FIG. 19 is a schematic view of an alternative system showing an additional working liquid pump for powering the fan shown in FIG. 18.

FIGS. 18 and 19 show an alternative arrangement in which the system includes a working liquid powered cooling fan which is operative to provide air flow for the air/liquid heat exchanger. In this exemplary arrangement an alternative control stand includes a heat exchanger 264. The exemplary heat exchanger provides for air/liquid heat exchange that is facilitated as a result of air flow created by at least one fan 266. The at least one fan 266 is in operative connection with a hydraulic motor 268. The at least one hydraulic motor is configured to rotate the fan responsive to a flow of working liquid therethrough.

In the alternative system arrangement shown in FIG. 19 a further positive displacement pump 270 is in operative rotatable connection with the driver 42. In the exemplary arrangement the pump 270 is in operative rotational connection with the driver through a common rotatable connection with the variable displacement pump/motor and the auxiliary pump 92. Of course this approach is exemplary and in other arrangements other driving approaches for the pump 270 may be used.

The pump 270 is supplied with working liquid from a line 272. The line 272 is in fluid connection with line 96 which receives working liquid from the tank 114. An electrically controllable valve 274 is positioned in line 272. The valve 274 is in operative connection with the at least one controller so as to control delivery of working liquid to an inlet 276 of the pump 270.

The working liquid is delivered from an outlet 278 of the pump 270. The working liquid delivered from the pump outlet is directed through a line 280 to the hydraulic motor 268. The motor 268 delivers the working liquid that causes rotational movement of the motor and the fan 266, to the line 86 that returns the working liquid through the heat exchanger to the tank.

Thus in the exemplary arrangement the alternative heat exchanger 264 may operate in a manner like that previously discussed in connection with heat exchanger 106. The at least one controller operates to receive at least one temperature signal from at least one temperature sensor associated with the heat exchanger, and makes a determination that the working liquid that has passed through the heat exchanger is above a set threshold. Responsive to the determination that the working liquid has reached a set threshold level which requires cooling, the at least one controller is operative to cause the valve 274 to open, which causes the hydraulic motor 268 to operate the at least one fan 266. In the event that the temperature drops so that cooling of the working liquid is no longer required, the at least one controller operates to close the valve 274 so that working liquid is no longer caused to pass through the hydraulic motor and the fan no longer operates. Of course it should be understood that this arrangement is exemplary and in other arrangements other approaches may be used.

Thus the exemplary arrangements achieve improved operation, eliminate difficulties encountered in the use of prior devices and systems, and attain the useful results described herein.

It should be understood that the features, structures, devices and characteristics that have been described herein in connection with various arrangements may be combined in any suitable manner to produce one or more other arrangements. That is, a particular feature, structure, device and/or characteristic described in connection with one arrangement may be included in other arrangements to provide the desired operational characteristics.

In the foregoing description certain terms have also been used for brevity, clarity and understanding. However, no unnecessary limitations are to be implied therefrom because such terms are used for descriptive purposes and are intended to be broadly construed. Moreover the descriptions and illustrations herein are by way of examples and the new and useful concepts are not limited to the features shown and described.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes and relationships are set forth in the appended claims.

I claim:

1. Apparatus comprising:

a rotary type variable output positive displacement pump/motor, wherein the pump/motor includes a rotatable input coupler configured to be in rotatable operative connection with a driver, which driver is operative to cause driving rotation of the input coupler, a pump/motor liquid outlet, a pump/motor liquid inlet, wherein the pump/motor is operative to receive working liquid into the pump/motor liquid inlet and deliver working liquid from the pump/motor liquid outlet at a selectively variable flow rate, a rotary type positive displacement motor/pump, wherein the motor/pump includes a motor/pump liquid inlet, a motor/pump liquid outlet a rotatable output coupler, wherein the rotatable output coupler is configured to be in operative connection with a pump jack, wherein the pump jack is in operative connection with a vertically reciprocated sucker rod string that is in operative connection with a subsurface pump operative to upwardly pump subterranean well liquid, and a vertically reciprocated counterweight that is configured to cause upward force that acts on the sucker rod, a pump/motor output liquid line, wherein the pump/motor output liquid line extends in closed liquid connection between the pump/motor liquid outlet and the motor/pump liquid inlet, a motor/pump output liquid line, wherein the motor/pump output liquid line extends in closed liquid connection between the motor/pump liquid outlet and the pump/motor liquid inlet, wherein the motor/pump is operative responsive to delivered working liquid received through the pump/motor output liquid line to cause the output coupler to rotate in a first rotational direction, which rotation of the output coupler in the first rotational direction is operative to cause reciprocated vertical motion of the sucker rod string in operative connection with the pump jack, wherein the pump jack is operative to apply a return force on the output coupler that urges the output coupler to rotate in the first rotational direction, wherein the return force is operative to cause the motor/pump to urge return working liquid to flow from the motor/pump liquid outlet, through the motor/pump output liquid line and to the pump/motor liquid inlet, whereby the return liquid operatively acts on the pump/motor to assist the driver in driving rotation of the input coupler.

2. The apparatus according to claim 1 wherein the motor/pump comprises a fixed positive displacement motor/pump.

3. The apparatus according to claim 2 wherein the pump/motor is operative to deliver working liquid from the pump/motor liquid outlet at the selectively variable flow rate in a continuous range from a zero flow rate to a maximum flow rate while the input coupler continuously rotates responsive to driving rotation at a generally constant rotational speed in a driving direction responsive to the driver, and further comprising:

at least one controller, and at least one manual input device, wherein the at least one controller is in operative connection with the pump/motor and the at least one manual input device, wherein at least one manual input to the at least one manual input device is operative to cause the at least one controller to operate to cause the pump/motor to selectively deliver from the pump/motor liquid outlet, a fixed flow rate of working liquid anywhere within the range while the input coupler continuously rotates at the generally constant rotational speed in the driving direction.

4. The apparatus according to claim 3 wherein the at least one manual input device comprises a manually rotatable knob, wherein the fixed flow rate varies with knob rotational position.

5. The apparatus according to claim 1 and further comprising:

at least one controller, at least one direction sensor, wherein the at least one direction sensor is operative to detect at least one direction feature that corresponds to a rod direction in which the sucker rod string is currently moving, at least one position sensor, wherein the at least one position sensor is operative to detect at least one position feature that corresponds to a current vertical position of the sucker rod string, wherein the at least one controller is in operative connection with the at least one direction sensor, the at least one position sensor and the pump/motor, wherein the at least one controller is operative to cause the pump/motor to vary the flow rate from the pump/motor liquid outlet responsive at least in part to the at least one sensed direction feature and the at least one sensed position feature, whereby the rotational speed of the rotatable output coupler in the first rotational direction is varied responsive at least in part to the current direction and position of the sucker rod string.

6. The apparatus according to claim 1 and further comprising:

at least one controller, at least one force sensor, wherein the at least one force sensor is in operative connection with the sucker rod string, wherein the at least one force sensor is operative to detect at least one property corresponding to at least one rod force acting on the sucker rod string, wherein the at least one controller is in operative connection with the at least one force sensor and the pump/motor, wherein the at least one controller is operative to cause the pump/motor to vary the flow rate from the pump/motor liquid outlet responsive at least in part to the at least one rod force acting on the sucker rod string detected by the at least one force sensor.

7. The apparatus according to claim 1 and further comprising:

at least one controller, at least one force sensor, wherein the at least one force sensor is in operative connection with the sucker rod string, wherein the at least one force sensor is operative to detect at least one property corresponding to at least one rod force acting on the sucker rod string, wherein the at least one controller is in operative connection with the at least one force sensor and the pump/motor, wherein the at least one controller is operative responsive at least in part to the at least one property sensed by the at least one force sensor to determine an amount of currently available pumpable well liquid at the subsurface pump, wherein the at least one controller is operative to vary the working liquid flow rate from the pump/motor liquid outlet responsive at least in part to the determined amount.

8. The apparatus according to claim 1 and further comprising:

at least one controller, at least one force sensor, wherein the at least one force sensor is in operative connection with the sucker rod string, wherein the at least one force sensor is operative to detect at least one property corresponding to at least one rod force acting on the sucker rod string, wherein the at least one controller is in operative connection with the at least one force sensor and the pump/motor, wherein the at least one controller is operative responsive at least in part to the at least one property sensed by the at least one force sensor to determine an amount of currently available pumpable well liquid at the subsurface pump, wherein the at least one controller is operative to vary the flow rate from the pump/motor liquid outlet responsive at least in part to the determined amount, but is operative to cause at least some working liquid flow to be delivered from the pump/motor liquid outlet regardless of the amount of currently available pumpable well liquid, whereby the sucker rod string continuously undergoes reciprocated movement.

9. The apparatus according to claim 1 wherein the pump/motor is operative to cause continuous delivery of working liquid to the motor/pump liquid inlet through the pump/motor output liquid line, wherein the motor/pump is operative responsive to the continuous delivered working liquid received through the motor/pump liquid inlet to cause the output coupler to rotate continuously in the first rotational direction, wherein the continuous rotation of the output coupler in the first rotational direction is operative to cause repeated reciprocated motion of the pump jack and the sucker rod string, wherein the repeated reciprocated motion is operative to cause application of the return force.

10. Apparatus comprising:

a rotary type variable output positive displacement pump/motor, wherein the pump/motor includes a rotatable input coupler configured to be in rotatable operative connection with a driver, wherein the driver is operative to cause driving rotation of the input coupler, a pump/motor liquid outlet, a pump/motor liquid inlet, wherein the pump/motor is operative to receive working liquid into the pump/motor liquid inlet and deliver working liquid from the pump/motor liquid outlet at a selectively variable flow rate, a rotary type positive displacement motor/pump, wherein the motor/pump includes a motor/pump liquid inlet, a motor/pump liquid outlet, a rotatable output coupler, wherein the rotatable output coupler is configured to be in operative connection with a pump jack operable to vertically reciprocate a sucker rod string, wherein the sucker rod string is in operative connection with a subsurface pump, wherein vertical reciprocation of the sucker rod string is operative to cause the pump to pump subterranean well liquid upward, wherein the pump jack repeatedly undergoes a cycle in which the sucker rod string moves downward and then upward, wherein the pump/motor liquid outlet is in closed liquid connection with the motor/pump liquid inlet and is operative to deliver working liquid to the motor/pump, and wherein the motor/pump liquid outlet is in closed liquid connection with the pump/motor liquid inlet and is operative to return working liquid to the pump/motor, wherein the motor/pump is operative responsive to the delivered working liquid to cause the output coupler to rotate in a first rotational direction, wherein the pump jack undergoes the cycle repeatedly responsive to rotation of the output coupler in the first rotational direction, and wherein during at least a portion of at least some cycles the pump jack is operative to cause a return force to be applied to the output coupler that acts to urge output coupler rotation in the first direction, wherein the return force is operative to cause the motor/pump to urge the return working liquid to move toward the pump/motor liquid inlet, wherein the return working liquid acts on the pump/motor to operatively assist the driver in driving rotation of the input coupler.

11. The apparatus according to claim 10 wherein the pump/motor liquid outlet is operative to continuously deliver working liquid to the motor/pump, wherein the continuously delivered working liquid is operative to cause the output coupler to continuously rotate in the first rotational direction, wherein the pump jack undergoes the cycle repeatedly responsive to the continuous rotation of the output coupler in the first rotational direction.

12. The apparatus according to claim 11 wherein the driver is operative to cause continuous driving rotation of the input coupler in a first input coupler rotational direction, wherein the return force is operative to assist in the continuous driving rotation of the input coupler in the first input coupler rotational direction.

13. Apparatus comprising:

a rotary type variable output positive displacement pump/motor, wherein the pump/motor includes a rotatable input coupler configured to be in rotatable operative connection with a driver, which driver is operative to cause driving rotation of the input coupler in an input coupler rotational direction, a pump/motor liquid outlet, a pump/motor liquid inlet, wherein the pump/motor is operative to receive working liquid into the pump/motor liquid inlet and deliver working liquid from the pump/motor liquid outlet at a selectively variable flow rate, a rotary type positive displacement motor/pump, wherein the motor/pump includes a motor/pump liquid inlet, a motor/pump liquid outlet, a rotatable output coupler, wherein the rotatable output coupler is configured to be in operative connection with a pump jack, wherein the pump jack is configured to be in operative connection with a vertically reciprocated sucker rod string that is in operative connection with a subsurface pump operative to upwardly pump subterranean well liquid, and a vertically reciprocated counterweight that is configured to cause upward force that acts on the sucker rod, a pump/motor output liquid line, wherein the pump/motor output liquid line extends in closed liquid connection between the pump/motor liquid outlet and the motor/pump liquid inlet, a motor/pump output liquid line, wherein the motor/pump output liquid line extends in closed liquid connection between the motor/pump liquid outlet and the pump/motor liquid inlet, wherein the motor/pump is operative responsive to delivered working liquid received through the pump/motor output liquid line to cause the output coupler to rotate continuously in an output coupler rotational direction and cause repeated reciprocated motion of the pump jack, the sucker rod string and the counterweight, wherein the reciprocated motion of the pump jack is operative to cause a return force to be applied on the output coupler that urges the output coupler to rotate in the output coupler rotational direction, wherein the return force is operative to cause the motor/pump to urge return working liquid to flow from the motor/pump liquid outlet, through the motor/pump output liquid line and to the pump/motor liquid inlet, whereby the return liquid flow operatively acts on the pump/motor to assist in rotation of the input coupler in the input coupler rotational direction by the driver.

14. Apparatus comprising:

a rotary type variable output positive displacement pump/motor, wherein the pump/motor includes a rotatable input coupler configured to be in rotatable operative connection with a driver, wherein the driver is operative to continuously cause driving rotation of the input coupler in an input coupler rotational direction, a pump/motor liquid outlet, a pump/motor liquid inlet, wherein the pump/motor is operative to receive working liquid into the pump/motor liquid inlet and deliver working liquid from the pump/motor liquid outlet at a selectively variable flow rate, a rotary type positive displacement motor/pump, wherein the motor/pump includes a motor/pump liquid inlet, a motor/pump liquid outlet, a rotatable output coupler, wherein the rotatable output coupler is configured to be in operative connection with a pump jack operable to vertically reciprocate a sucker rod string, wherein the sucker rod string is in operative connection with a subsurface pump, wherein vertical reciprocation of the sucker rod string is operative to cause the pump to pump subterranean well liquid upward, wherein the pump jack repeatedly undergoes a cycle in which the sucker rod moves downward and then upward, wherein the pump/motor liquid outlet is in closed liquid connection with the motor/pump liquid inlet and is operative to continuously deliver working liquid to the motor/pump liquid inlet, and wherein the motor/pump liquid outlet is in closed liquid connection with the pump/motor liquid inlet and is operative to return working liquid to the pump/motor liquid inlet, wherein the motor/pump is operative responsive to the delivered working liquid to cause the output coupler to continuously rotate in an output coupler rotational direction, wherein the pump jack is caused to undergo the cycle repeatedly responsive to continuous rotation of the output coupler in the output coupler rotational direction, and wherein during at least a portion of at least some cycles the pump jack is operative to cause a return force to be applied to the output coupler that acts to urge output coupler rotation in the output coupler rotational direction, wherein the return force is operative to cause the motor/pump to force the return working liquid to flow toward the pump/motor liquid inlet, wherein the force of the return working liquid acts on the pump/motor to operatively assist in driving rotation of the input coupler in the input coupler rotational direction.

15. Apparatus comprising:

a rotary type variable output positive displacement pump/motor, wherein the pump/motor includes a rotatable input coupler configured to be in rotatable operative connection with a driver, which driver is operative to cause driving rotation of the input coupler, a pump/motor liquid outlet, a pump/motor liquid inlet, wherein the pump/motor is selectively operative to receive working liquid into the pump/motor liquid inlet and deliver working liquid from the pump/motor liquid outlet at a selectively variable flow rate in a continuous range from a zero flow rate to a maximum flow rate while the input coupler continuously rotates responsive to the driving rotation at a generally constant rotational speed in a driving direction responsive to the driver, or deliver working liquid from the pump/motor liquid outlet at the selectively variable flow rate in a continuous reverse flow range from the zero flow rate to a maximum reverse flow rate, while the input coupler continuously rotates responsive to the driving rotation at the generally constant rotational speed in the driving direction, a rotary type positive displacement motor/pump, wherein the motor/pump comprises a fixed positive displacement motor pump, and includes a motor/pump liquid inlet, a motor/pump liquid outlet, a rotatable output coupler, wherein the rotatable output coupler is configured to be in operative connection with a pump jack, wherein the pump jack is in operative connection with a vertically reciprocated sucker rod string that is in operative connection with a subsurface pump operative to upwardly pump subterranean well liquid, and a vertically reciprocated counterweight that is configured to cause upward force that acts on the sucker rod string, a pump/motor output liquid line, wherein the pump/motor output liquid line extends in closed liquid connection between the pump/motor liquid outlet and the motor/pump liquid inlet, a motor/pump output liquid line, wherein the motor/pump output liquid line extends in closed liquid connection between the motor/pump liquid outlet and the pump/motor liquid inlet, wherein the motor/pump is operative responsive to delivered working liquid received through the pump/ motor output liquid line to cause the output coupler to rotate in a first rotational direction, and cause reciprocated motion of the pump jack, wherein the pump jack is operative to apply a return force on the output coupler that urges the output coupler to rotate in the first direction, wherein the return force is operative to cause the motor/pump to urge return working liquid to flow from the motor/pump liquid outlet, through the motor/pump output liquid line and to the pump/motor liquid inlet, whereby the return liquid operatively acts on the pump/motor to assist the driver in driving rotation of the input coupler, at least one controller, and at least one manual input device, wherein the at least one controller is in operative connection with the pump/motor and the at least one manual input device, wherein at least one manual input to the at least one manual input device is operative to cause the at least one controller to operate to cause the pump/motor to selectively deliver from the pump/motor liquid outlet, a fixed flow rate of working liquid anywhere within the range while the input coupler continuously rotates at the generally constant rotational speed in the driving direction, wherein at least one further manual input to the at least one manual input device is operative to cause the at least one controller to operate to cause the pump/motor to selectively deliver from the pump/motor liquid outlet, the fixed flow rate within the reverse flow range while the input coupler continuously rotates at the generally constant rotational speed in the driving direction, wherein working liquid flow in the reverse flow range above the zero flow rate is operative to cause the rotatable output coupler to rotate in a second rotational direction opposed of the first rotational direction, whereby the pump jack operates to cause the sucker rod string and the counterweight to vertically reciprocate when the rotatable output coupler rotates in the second rotational direction.

16. The apparatus according to claim 15, wherein the at least one controller is operative to selectively cause the rotatable output coupler to rotate in the first rotational direction and in the second rotational direction.

17. The apparatus according to claim 15, and further comprising:

at least one direction sensor, wherein the at least one direction sensor is operative to detect at least one direction feature, wherein the at least one direction feature corresponds to a rod direction in which the sucker rod is currently moving, and at least one position sensor, wherein the at least one position sensor is operative to detect at least one position feature, wherein the at least one position feature corresponds to a current vertical position of the sucker rod string, wherein each of the at least one direction sensor and the at least one position sensor are in operative connection with the at least one controller, wherein the at least one manual input device is further operative to manually receive at least one direct automatic control input, wherein responsive at least in part to the at least one direct automatic control input, the at least one controller is operative to cause the pump/motor to vary the flow rate from the pump/motor liquid outlet responsive at least in part to the at least one sensed direction feature and the at least one sensed position feature, whereby the rotational speed of the rotatable output coupler is varied responsive at least in part to the current direction and the current vertical position of the sucker rod string.

18. The apparatus according to claim 17 and further comprising:

at least one force sensor, wherein the at least one force sensor is in operative connection with the sucker rod string, wherein the at least one force sensor is operative to detect at least one property corresponding to at least one rod force acting on the sucker rod string, wherein the at least one force sensor is in operative connection with the at least one controller, wherein the at least one controller is operative to cause the pump/motor to vary the flow rate from the pump/motor liquid outlet responsive at least in part to at least one rod force acting on the sucker rod string detected by the at least one force sensor.

19. The apparatus according to claim 18 wherein the at least one controller is operative responsive at least in part to the at least one property sensed by the at least one force sensor to determine an amount of currently available pumpable well liquid at the subsurface pump, wherein the at least one controller is operative to vary the flow rate from the pump/motor liquid outlet responsive at least in part to the determined amount.

20. The apparatus according to claim 19 wherein the at least one controller is operative to cause at least some working liquid flow to be delivered from the pump/motor liquid outlet regardless of the determined amount, whereby the sucker rod string continuously undergoes reciprocated movement.

21. The apparatus according to claim 20 and further comprising:

a control stand, a working liquid/air heat exchanger in operative supported connection with the control stand, wherein the heat exchanger is in operative liquid connection with the pump/motor, a control panel, wherein the control panel is in operative supported connection with the control stand, wherein the control panel houses at least a portion of the at least one controller, at least one fan, wherein the at least one fan is in operative supported connection with the control stand, wherein the at least one fan is operative to both move air over the control panel to cool the control panel and to move air through the heat exchanger to cool the working liquid.

22. The apparatus according to claim 21 and further including a working liquid holding tank, wherein the tank is in operatively supported connection with the control stand, a working liquid catch pan, wherein the working liquid catch pan is in operatively supported connection with the control stand, wherein the tank is positioned vertically below the control panel and the catch pan is positioned vertically below the tank.

23. The apparatus according to claim 22 wherein the control stand further includes a roof, wherein the roof extends above the control panel, the heat exchanger, the tank and the catch pan, at least one lifting fork opening, wherein the at least one lifting fork opening is configured to receive at least one lifting fork therein, wherein the at least one lifting fork opening is positioned below the control panel, the heat exchanger, the tank and the catch pan.

24. The apparatus according to claim 22 wherein the motor/pump includes a motor/pump case, wherein the motor/pump case includes a lubrication chamber in which fluid pressure does not act to drive the motor/pump, wherein the motor/pump case includes a motor/pump lubrication chamber inlet and a motor/pump lubrication chamber outlet, wherein the motor/pump lubrication chamber outlet is in liquid connection with the heat exchanger and the tank, and further including a shuttle valve, wherein the shuttle valve is in intermediate liquid connection between the motor/pump liquid outlet and the motor/pump lubrication chamber inlet, wherein the shuttle valve is operative to cause at least some working liquid delivered from the motor/pump liquid outlet to pass through the shuttle valve, through the motor/pump lubrication chamber and to the tank.

25. The apparatus according to claim 24 and further including an auxiliary pump, wherein the auxiliary pump is in operatively driven connection with the driver, wherein the auxiliary pump is in intermediate liquid connection between the tank and the pump/motor, wherein the auxiliary pump is operative to deliver replacement working liquid to the pump/motor, wherein the replacement working liquid replaces working liquid directed to the tank by the shuttle valve.

26. The apparatus according to claim 25 and further including at least one working liquid temperature sensor, wherein the at least one working liquid temperature sensor is in operative connection with the at least one controller, wherein the at least one controller is operative responsive at least in part to a temperature of working liquid sensed through operation of the at least one temperature sensor to make a first temperature determination that the working liquid temperature is below a first temperature threshold, wherein the at least one controller is operative responsive to the first determination to cause the pump/motor to operate to provide a zero flow rate at the pump/motor outlet, wherein after the first determination the at least one controller is operative responsive to a further temperature of working liquid sensed through operation of the at least one temperature sensor to make a second temperature determination that the working liquid is at least at a second temperature threshold, wherein the at least one controller is operative responsive at least in part to the second temperature determination to cause the pump/motor to operate to provide other than the zero flow rate at the pump/motor outlet.

27. The apparatus according to claim 26 and further comprising:

a first manually closable lockout valve, wherein the first lockout valve is in direct liquid connection with the motor/pump liquid inlet, a second manually closable lockout valve, wherein the second manually closable lockout valve is in direct liquid connection with the motor/pump liquid outlet, wherein with both the first lockout valve and the second lockout valve closed the rotatable output coupler is caused to be fluidly locked in position.

28. The apparatus according to claim 26 and further comprising:

at least one working liquid filter, wherein the filter is operative to remove contaminants from the working liquid, at least one filter sensor, wherein the at least one filter sensor is operative to sense at least one property corresponding to a rate of working liquid flow through the filter, wherein the at least one filter sensor is in operative connection with the at least one controller, wherein the at least one controller is operative responsive at least in part to the at least one filter sensor to make a filter restricted flow determination, wherein the at least one controller is operative responsive at least in part to the filter restricted flow determination to cause the pump/motor to cease operation.

29. The apparatus according to claim 26 and further comprising:

the driver, wherein the driver is operative to cause rotation of the input coupler responsive to combustion of well derived gas, a skid, wherein the driver and the control stand are in operatively supported connection with the skid.

30. The apparatus according to claim 29 and further comprising:

at least one of a solar panel and a wind turbine electric generator, wherein the at least one of the solar panel and the wind turbine electric generator are operative to provide electricity to the at least one controller.

31. The apparatus according to claim 30 and further comprising:

a wireless communication interface, wherein the wireless communication interface is in operative connection with the at least one controller, wherein the at least one controller is operative to control the pump/motor responsive at least in part to communication through the wireless communication interface.

32. The apparatus according to claim 31 wherein the pump/motor is operative to cause continuous delivery of working liquid to the motor/pump liquid inlet, wherein the motor/pump is operative responsive to the continuously delivered working liquid received through the pump/motor liquid output line to cause the output coupler to rotate continuously in the first rotational direction, wherein the continuous rotation of the output coupler in the first rotational direction is operative to cause repeated reciprocated motion of the pump jack and the sucker rod string, wherein the repeated reciprocated motion is operative to cause application of the return force.

33. Apparatus comprising:

a rotary type variable output positive displacement pump/motor, wherein the pump/motor includes a rotatable input coupler configured to be in rotatable operative connection with a driver, which driver is operative to cause driving rotation of the input coupler, a pump/motor liquid outlet, a pump/motor liquid inlet, wherein the pump/motor is operative to receive working liquid into the pump/motor liquid inlet and deliver working liquid from the pump/motor liquid outlet at a selectively variable flow rate, a rotary type positive displacement motor/pump, wherein the motor/pump includes a motor/pump liquid inlet, a motor/pump liquid outlet, a rotatable output coupler, wherein the rotatable output coupler is configured to be in operative connection with a pump jack, wherein the pump jack is in operative connection with a vertically reciprocated sucker rod string that is in operative connection with a subsurface pump operative to upwardly pump subterranean well liquid, and a vertically reciprocated counterweight that is configured to cause upward force that acts on the sucker rod string, a pump/motor output liquid line, wherein the pump/motor output liquid line extends in closed liquid connection between the pump/motor liquid outlet and the motor/pump liquid inlet, a motor/pump output liquid line, wherein the motor/pump output liquid line extends in closed liquid connection between the motor/pump liquid outlet and the pump/motor liquid inlet, wherein the motor/pump is operative responsive to delivered working liquid received through the pump/motor output liquid line to cause the output coupler to rotate in a first rotational direction and cause reciprocated motion of the pump jack, wherein the pump jack is operative to apply a return force on the output coupler that urges the output coupler to rotate in the first rotational direction, wherein the return force is operative to cause the motor/pump to urge return working liquid to flow from the motor/pump liquid outlet, through the motor/pump output liquid line and to the pump/motor liquid inlet, whereby the return liquid operatively acts on the pump/motor to assist the driver in driving rotation of the input coupler, a control stand, a working liquid/air heat exchanger in operative supported connection with the control stand, wherein the heat exchanger is in operative liquid connection with the pump/motor, a control panel, wherein the control panel is in operative supported connection with the control stand, wherein the control panel houses at least a portion of at least one controller, wherein the at least one controller is in operative connection with the at least one pump/motor, at least one fan, wherein the at least one fan is in operative supported connection with the control stand, wherein the at least one fan is operative to both move air over the control panel to cool the control panel and move air through the heat exchanger to cool the working liquid.

34. Apparatus comprising:

a rotary type variable output positive displacement pump/motor, wherein the pump/motor includes a rotatable input coupler configured to be in rotatable operative connection with a driver, which driver is operative to cause driving rotation of the input coupler, a pump/motor liquid outlet, a pump/motor liquid inlet, wherein the pump/motor is operative to receive working liquid into the pump/motor liquid inlet and deliver working liquid from the pump/motor liquid outlet at a selectively variable flow rate, a rotary type positive displacement motor/pump, wherein the motor/pump includes a motor/pump liquid inlet, a motor/pump liquid outlet a rotatable output coupler, wherein the rotatable output coupler is configured to be in operative connection with a pump jack, wherein the pump jack is in operative connection with a vertically reciprocated sucker rod string that is in operative connection with a subsurface pump operative to upwardly pump subterranean well liquid, and a vertically reciprocated counterweight that is configured to cause upward force that acts on the sucker rod, a pump/motor output liquid line, wherein the pump/motor output liquid line extends in closed liquid connection between the pump/motor liquid outlet and the motor/pump liquid inlet, a motor/pump output liquid line, wherein the motor/pump output liquid line extends in closed liquid connection between the motor/pump liquid outlet and the pump/motor liquid inlet, wherein the motor/pump is operative responsive to delivered working liquid received through the pump/motor output liquid line to cause the output coupler to rotate in a first rotational direction, which rotation of the output coupler in the first rotational direction is operative to cause reciprocated vertical motion of the sucker rod string in operative connection with the pump jack, wherein the pump jack is operative to apply a return force on the output coupler that urges the output coupler to rotate in the first rotational direction, wherein the return force is operative to cause the motor/pump to urge return working liquid to flow from the motor/pump liquid outlet, through the motor/pump output liquid line and to the pump/motor liquid inlet, whereby the return liquid operatively acts on the pump/motor to assist the driver in driving rotation of the input coupler, a first manually closable lockout valve, wherein the first lockout valve is in direct liquid connection with the motor/pump liquid inlet, a second manually closable lockout valve, wherein the second manually closable lockout valve is in direct liquid connection with the motor/pump liquid outlet, wherein with both the first lockout valve and the second lockout valve closed the rotatable output coupler is caused to be fluidly locked in position.

* * * * *